US007639957B2

(12) United States Patent
Kato et al.

(10) Patent No.: US 7,639,957 B2
(45) Date of Patent: Dec. 29, 2009

(54) IMAGE FORMING APPARATUS INCLUDING CONTROLLER TO DETECT CONDITION OF IMAGE DEVELOPER

(75) Inventors: Shinji Kato, Kawasaki (JP); Koji Suzuki, Yokohama (JP); Yasushi Koichi, Yamato (JP); Shigekazu Enoki, Kawasaki (JP); Wakako Murakami, Kokubunji (JP); Kumiko Hatakeyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 249 days.

(21) Appl. No.: 11/738,342

(22) Filed: Apr. 20, 2007

(65) Prior Publication Data

US 2007/0248368 A1 Oct. 25, 2007

(30) Foreign Application Priority Data

Apr. 20, 2006 (JP) ..... 2006-116480

(51) Int. Cl.
*G03G 15/08* (2006.01)

(52) U.S. Cl. ..... 399/30

(58) Field of Classification Search ..... 399/27, 399/29, 30, 252, 257, 258
See application file for complete search history.

(56) References Cited

U.S. PATENT DOCUMENTS

| | | | |
|---|---|---|---|
| 4,614,165 | A | 9/1986 | Folkins et al. |
| 5,860,038 | A | 1/1999 | Kato et al. |
| 6,055,386 | A | 4/2000 | Kato et al. |
| 6,081,678 | A | 6/2000 | Kato |
| 6,112,046 | A | 8/2000 | Suzuki et al. |
| 6,526,235 | B2 | 2/2003 | Kato |
| 6,594,453 | B2 | 7/2003 | Kato |
| 6,934,484 | B2 | 8/2005 | Suzuki et al. |
| 7,003,251 | B2 | 2/2006 | Suzuki et al. |
| 7,020,421 | B2 | 3/2006 | Enoki et al. |
| 7,027,760 | B2 | 4/2006 | Enoki |
| 7,125,638 | B2 | 10/2006 | Suzuki et al. |

(Continued)

FOREIGN PATENT DOCUMENTS

| | | |
|---|---|---|
| JP | 51-13249 | 2/1976 |

(Continued)

OTHER PUBLICATIONS

U.S. Appl. No. 12/112,525, filed Apr. 30, 2008, Koizumi, et al.

*Primary Examiner*—Quana M Grainger
(74) *Attorney, Agent, or Firm*—Oblon, Spivak, McClelland, Maier & Neustadt, L.L.P.

(57) ABSTRACT

An image forming apparatus includes an image carrier, a developing unit, a concentration sensor, a toner supplying unit, a developer supplying unit, an ejector, and a condition detector. The image carrier forms a latent image thereon. The developing unit develops the latent image formed on the image carrier with a two-component image developer including toner particles and carrier particles. The concentration sensor detects a toner ratio in the developing unit. The toner supplying unit supplies fresh toner particles to the developing unit. The developer supplying unit supplies fresh image developer to the developing unit. The ejector ejects the image developer to an outside of the developing unit. The condition detector detects a condition of the image developer used for an image forming operation to determine a supply amount of the image developer to supply to the developing unit. The condition includes a degradation level of the image developer.

19 Claims, 16 Drawing Sheets

U.S. PATENT DOCUMENTS

| | | | |
|---|---|---|---|
| 7,162,187 | B2 | 1/2007 | Koichi et al. |
| 7,190,912 | B2 | 3/2007 | Kato et al. |
| 7,203,433 | B2 | 4/2007 | Kato et al. |
| 2005/0030595 | A1 | 2/2005 | Koichi et al. |
| 2005/0141917 | A1 | 6/2005 | Enoki et al. |
| 2005/0169668 | A1 | 8/2005 | Koichi et al. |
| 2006/0024076 | A1 | 2/2006 | Kato et al. |
| 2006/0024095 | A1 | 2/2006 | Suzuki et al. |
| 2006/0120741 | A1 | 6/2006 | Murakami et al. |

FOREIGN PATENT DOCUMENTS

| | | |
|---|---|---|
| JP | 53-022747 | 3/1978 |
| JP | 59-100471 | 6/1984 |
| JP | 7-111598 | 11/1995 |
| JP | 09-204105 | 8/1997 |
| JP | 09-251235 | 9/1997 |
| JP | 09-269644 | 10/1997 |

IMAGE FORMING APPARATUS INCLUDING CONTROLLER TO DETECT CONDITION OF IMAGE DEVELOPER

TECHNICAL FIELD

The present disclosure generally relates to an image forming apparatus using electrophotography, and more particularly to an image forming apparatus using an image developer having carrier and toner particles.

BACKGROUND

An image forming apparatus using electrophotography may include a copier, printer, and facsimile, for example.

Such an image forming apparatus may have a charging unit, by which a photoconductive member may be charged with a substantially uniform voltage (or potential). Then, a light beam corresponding to a document image may be irradiated on the charged surface of the photoconductive member to form an electrostatic latent image, corresponding to the document image.

Such an electrostatic latent image may be developed as a visible image (e.g., a toner image) with an image developer having carrier particles and toner particles.

For example, in a case of a developing process using a magnetic brush, an image developer having magnetic carrier particles and toner particles (e.g., color resin) may be used to develop an electrostatic latent image formed on a photoconductive member.

Such a developed toner image on a photoconductive member may be transferred to a transfer sheet, and then fixed on the transfer sheet by a fixing unit, which may apply heat to the transfer sheet.

In such an image forming apparatus using electrophotography, toner particles in the image developer may be consumed gradually during a process of developing latent images with toner particles, by which a ratio of carrier and toner in image developer may change over time.

If a toner ratio in the image developer is reduced, a developed image concentration may also be unfavorably reduced. Accordingly, toner particles may need to be refilled at a given timing.

However, if a refilling amount of toner particles is too great, an image quality on a transfer sheet may be degraded, which may be observed as an increased image concentration, or an unintended image on a transfer sheet.

Accordingly, a toner ratio in the image developer may need to be maintained at a given preferable level to continuously obtain a higher quality image having a preferable concentration level.

In view of such background, methods of automatically controlling a toner ratio in an image developer have been devised.

For example, one method is to determine a toner ratio in an image developer by detecting an image concentration of a test pattern formed on a photoconductive member with an optical detector. Another method is to determine a toner ratio in an image developer by measuring a magnetic permeability of the image developer.

Based on a detection signal obtained by such methods, a controller may instruct a toner supply mechanism, provided to a developing unit, to supply toner particles into a developing unit to maintain a toner ratio in the image developer at a given preferable level.

Although such methods may be employed for an image forming apparatus (e.g., copier, printer, facsimile) using electrophotography to maintain a toner ratio in image developer at a given preferable level, an image quality formed on a transfer sheet may be degraded when an image forming apparatus conducts image forming operations (e.g., copying, printing) for a relatively greater number of times.

Such image quality degradation may be caused by a lifetime of the image developer, for example. As mentioned above, the image developer in a developing unit may have carrier particles and toner particles, wherein a ratio of toner in the image developer may be several percent. Accordingly, the image developer may consist mostly of carrier particles while including a small percentage of toner particles.

As mentioned above, toner particles may be gradually consumed during a process of developing latent images with toner particles while carrier particles may not be consumed in such a developing process. The carrier particles may be recirculated and reused in a developing unit. With such repeated use of carrier particles, carrier particles may be aged and degraded.

Such an image developer may be aged and degraded as described below. For example, a surface of carrier particles may be covered with toner particles by conducting a developing process for a greater number of times, or a surface of carrier particles may be damaged by conducting a developing process for a greater number of times.

As for such an image developer having a given lifetime, a replacement of image developer may be conducted when a service person conducts a maintenance work for an image forming apparatus, for example.

However, such replacement work may take some time, which may not a favorable aspect for a user of image forming apparatus.

In view of such background, a recent market demand may include a reduction of down time of an image forming apparatus caused by maintenance work such as replacement of image developer. Furthermore, some users may be demanding a substantial elimination of replacement work of image developer.

Furthermore, carrier particles may be agitated in a developing unit for transporting carrier particles in the developing unit. Accordingly, a surface of the carrier particles may be damaged by physical stress, by which charge-ability or electric resistance of the carrier particles may be degraded. Furthermore, toner particles or additives may adhere on the surface of the carrier particles and may form a film on the carrier particles.

With such degradation, carrier particles and toner particles may not be charged at a normal level, by which an unfavorable phenomenon may occur. For example, toner sputtering, unintended image formation, and/or carrier particle adhesion may occur.

As for a reduction of down time of an image forming apparatus, caused by replacement work of image developer, the following related art has been devised.

One related art apparatus using electrophotography has a developing unit, and a supply unit. Such a supply unit may supply a given amount of carrier particles to the developing unit when a given developing time has passed or when a given amount of copying operations has been conducted.

In such an apparatus, a condition of the image developer in the developing unit may be maintained at a given level by a given process such as "refilling fresh carrier particles into the developing unit in addition to refill toner particles, consumed by image forming operation," "ejecting excessive image developer from a developing unit," and "replacing degraded image developer from a developing unit," for example.

Such a method may be termed a "trickle developing system," which may be used in a developing unit for an image forming apparatus such as a copier using electrophotography.

In such a trickle developing system, fresh carrier particles may be refilled into a developing unit while separately refilling toner particles consumed by image forming operata ions.

In such trickle developing system, an excessive amount of image developer in the developing unit may be overflowingly ejected from an ejecting port, provided in a wall face of the developing unit, and such overflowed image developer may be recovered by a recovery unit.

Such refilling of carrier particles and ejection of degraded image developer may be repeated in the developing unit. With such a refilling and ejection process, degraded image developer may be replaced by fresh toner particles and carrier particles supplied to the developing unit.

With such a process, a charging ability of the image developer may be maintained at a given level, and thereby a degradation of image quality may be suppressed or reduced.

Furthermore, in a developing unit of another related art apparatus, a refilling amount of toner and an ejection amount of image developer may be controlled by detecting an image developer volume in an image developer container.

Furthermore, in a developing unit of another related art apparatus, a relationship between an aging speed of carrier particles and a charge-ability of toner particles in a housing may be set as a mathematical function. Carrier particles may be added into the housing at a given timing based on referring to the mathematical function. With such a mathematical function setting, a lifetime of the image developer and a lifetime of the image forming apparatus (e.g., printer) may be set to a substantially equal time.

Furthermore, in another related art apparatus, a refilling amount of carrier particles may be changed (or adjusted) based on a toner consumption amount. For example, if a toner consumption amount becomes greater, the refilling amount of carrier particles may be increased. Accordingly, carrier particles may be refilled by checking a degradation level of the carrier particles, wherein such a degradation level may become different depending on the toner consumption amount.

However, a degradation level of the carrier particles may not be determined only by a toner consumption amount, and a toner ratio in the image developer may not be a stable level when refilling the carrier particles. Therefore, an unfavorable change may occur to a toner and carrier ratio in a developing unit if a toner refilling amount and a carrier refilling amount may be determined only by the toner consumption amount.

Furthermore, in another related art apparatus, a degradation level of an image developer may be detected and then image developer may be replaced, in which a total amount of image developer in a developing unit may be replaced with fresh image developer.

Accordingly, such total replacement of the image developer may be different from a trickle developing system, and in such a total replacement method, a down time caused by replacement work of image developer may become relatively longer, which may not be preferable.

In background art apparatuses, a given amount of image developer may be refilled based on a number of printed sheets, or an image developer may be refilled by mixing carrier particles with refilling toner particles.

Such methods may be set based upon an assumption that carrier particles may degrade at a given timing, which may be set in advance, and may refill fresh image developer or carrier particles when such a given timing has elapsed.

Accordingly, if an actual degradation timing of image developer is later than an assumed degradation timing, an image developer that is still usable for image forming may be replaced from a developing unit with fresh image developer and fresh carrier particles, which may not be preferable from a viewpoint of saving material.

Furthermore, if an actual degradation timing of image developer is earlier than an assumed degradation timing, fresh image developer and carrier particles may not be refilled at a correct timing, by which image quality may degrade.

Accordingly, in some cases, a refilling amount or replacement amount of image developer and carrier particles may not match a degradation level of the image developer and carrier particles, by which a degradation of image quality may not be effectively suppressed or reduced, and a lifetime of image developer may not be effectively extended.

For example, a system, which may refill carrier particles by mixing carrier particles to refilling toner particles, may have a drawback when images having a lower image area ratio are printed for a greater number of times. In such an image forming process, toner particles may not be refilled for a longer period of time, and thereby carrier particles may be agitated in a developing unit without refilling the developing unit with fresh carrier particles for a longer period of time, by which carrier particles in the developing unit may degrade significantly.

Such a system, in which carrier particles may be refilled by mixing carrier particles with refilling toner particles when refilling toner particles, may have another drawback when images having a higher image area ratio are printed for a greater number of times. In such an image forming process, a greater amount of toner particles may be refilled due to a consumption of a greater amount of toner particles, and also a greater amount of carrier particles may be refilled at the same time, by which the amount of refilling carrier particles in the developing unit may exceed a required refilling amount of carrier particles, which may not be preferable from a viewpoint of saving carrier particles.

SUMMARY

The present disclosure relates to an image forming apparatus having an image carrier, a developing unit, a concentration sensor, a toner supplying unit, a developer supplying unit, an ejector, and a condition detector. The image carrier forms a latent image thereon with a light beam. The developing unit develops the latent image formed on the image carrier with a two-component image developer including toner particles and carrier particles. The concentration sensor detects a toner ratio in the developing unit. The toner supplying unit supplies fresh toner particles to the developing unit. The developer supplying unit supplies fresh image developer to the developing unit. The ejector ejects the image developer to an outside of the developing unit. The condition detector detects a condition of the image developer used for an image forming operation to determine a supply amount of the image developer to supply to the developing unit. The condition includes a degradation level of the image developer in the developing unit.

The present disclosure also relates to an image forming apparatus having an image carrier, a developing unit, a concentration sensor, a toner supplying unit, a carrier supplying unit, an ejector, and a condition detector. The image carrier forms a latent image thereon with a light beam. The developing unit develops the latent image formed on the image carrier with a two-component image developer including toner particles and carrier particles. The concentration sensor detects a toner ratio in the developing unit. The toner supplying unit supplies fresh toner particles to the developing unit. The carrier supplying unit supplies fresh carrier particles to the developing unit. The ejector ejects the image developer to an outside of the developing unit. The condition detector detects a condition of the image developer used for an image forming operation to determine a supply amount of the toner particles and the carrier particles to supply to the developing unit. The condition includes a degradation level of the image developer in the developing unit.

The present disclosure also relates to an image forming apparatus having an image carrier, a developing unit, a concentration sensor, a developer supplying unit, an ejector, and a condition detector. The image carrier forms a latent image thereon with a light beam. The developing unit develops the latent image formed on the image carrier with an image developer including toner particles. The concentration sensor detects a toner ratio in the developing unit. The developer supplying unit supplies fresh image developer to the developing unit. The ejector ejects the image developer to an outside of the developing unit. The condition detector detects a condition of the image developer used for an image forming operation to determine a supply amount of the image developer to supply to the developing unit. The condition includes a degradation level of the image developer in the developing unit.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
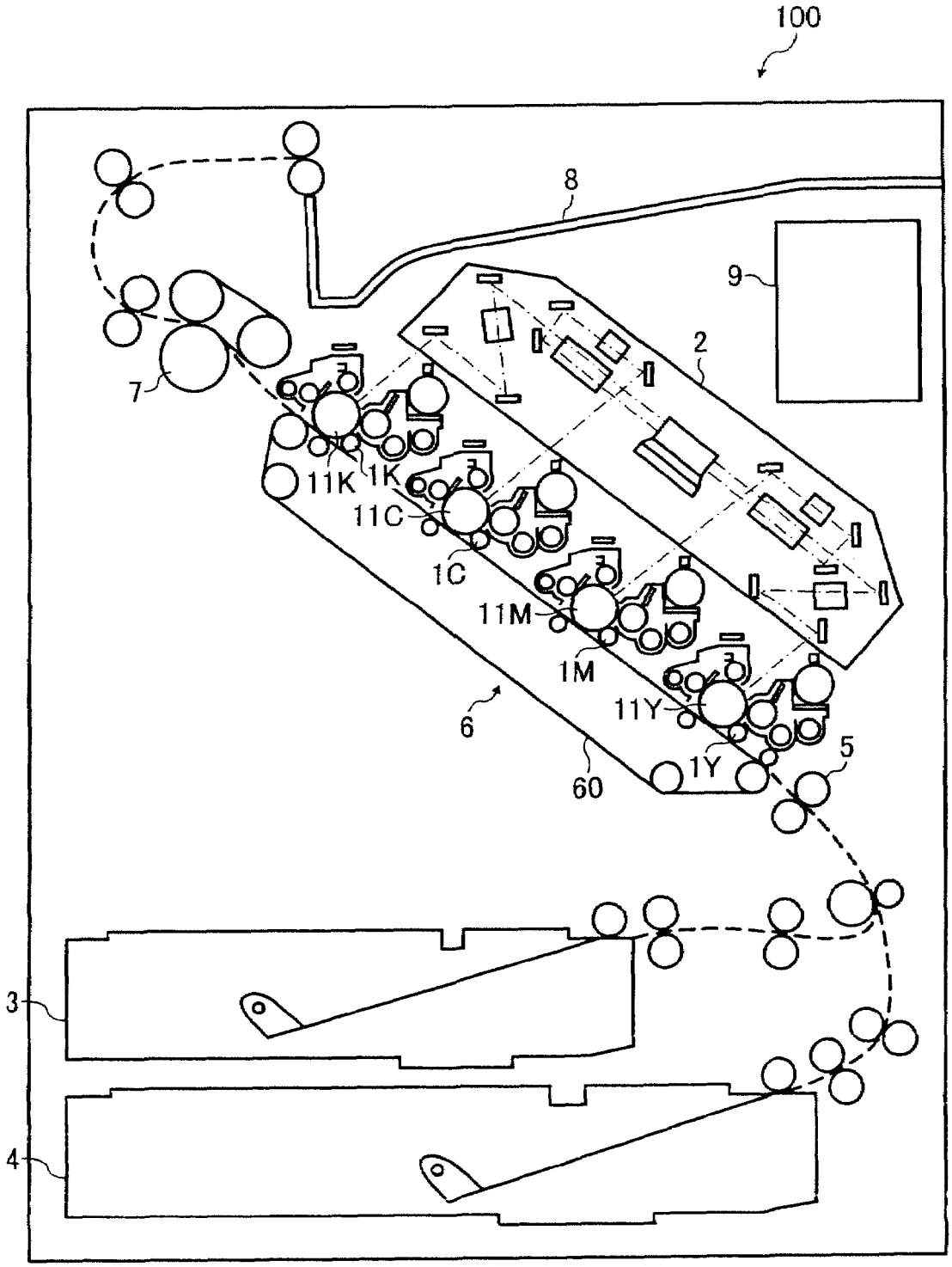
FIG. 1 shows a schematic configuration of an image forming apparatus according to an exemplary embodiment.

The accompanying drawings are intended to depict exemplary embodiments of the present invention and should not be interpreted to limit the scope thereof. The accompanying drawings are not to be considered as drawn to scale unless explicitly noted.

DETAILED DESCRIPTION OF EXEMPLARY EMBODIMENTS

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there is no intervening elements or layers present.

Like numbers refer to like elements throughout. As used herein, the term "and/or" includes any and all combinations of one or more of the associated listed items.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

In describing exemplary embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an exemplary embodiment is described with particular reference to FIG. 1.

FIG. 1 shows a schematic configuration of an image forming apparatus 100 according to an exemplary embodiment.

As show in FIG. 1, the image forming apparatus 100 may include a developing unit 1 (e.g., 1Y, 1M, 1C, 1K), an optical writing unit 2, sheet cassettes 3 and 4, a registration roller 5, a transfer unit 6, a fixing unit 7, a sheet ejection tray 8, a toner cartridge 9, and a transfer belt 60, for example.

The developing units 1Y, 1M, 1C, and 1K, arranged in tandem manner, may be used for forming an image of yellow (Y), magenta (M), cyan (C), and black (K) colors, respectively. The developing units 1Y, 1M, 1C, and 1K may be arranged in a given order as shown in FIG. 1, for example.

Hereinafter, reference characters Y, M, C, K may indicate a color of yellow, magenta, cyan, and black, respectively.

The developing units 1Y, 1M, 1C, and 1K may include photoconductor drums 11Y, 11M, 11C, and 11K, respectively, as image carriers.

The toner cartridge 9 may include color toner particles of Y, C, M, and K to be refilled to the developing units 1Y, 1M, 1C, and 1K, respectively.

The optical writing unit 2 may be used to form a latent image on the photoconductor drums 11Y, 11M, 11C, and 11K with a light beam.

Such a photoconductor drum 11 may include a conductive base layer made of aluminum, an under layer (UL) formed on the conductive base layer, a charge generating layer (CGL) formed on the UL, a charge transport layer (CTL) formed on the CGL, and a surface protection layer coated on the CTL, for example.

The surface protection layer may include micronized particles, having a higher hardness, dispersed in the surface protection layer.

Such micronized particles may include metal oxides, alumina, silicon carbide, chrome oxide, silicon nitride, titanium oxide, iron monoxide, silicon oxide, calcium carbide, zinc oxide, $\alpha$-$Fe_2O_3$, talc, kaolin, calcium sulfate, boron nitride, zinc fluoride, molybdenum dioxide, calcium carbonate, $Si(OH)_2.nH_2O$, clay, boron carbide, cerium oxide, or the like.

Furthermore, micronized particles may include organic material powder such as benzoguanamine resin, melamine resin, or alloys.

Such micronized particles may have a Mohs hardness of five or greater, and may have an average particle diameter of 1 μm or less, for example.

Although not shown, the developing unit 1 may include a cleaning unit having a cleaning blade.

The cleaning blade may have an edge, contacted to a surface of photoconductor drum 11 at a given angle and a given contact pressure to remove toner particles remaining on the photoconductor drum 11.

Furthermore, a brush roller (not shown), provided at an upstream side of the cleaning blade, may rotate while contacting the photoconductor drum 11 so that toner particles remaining on the photoconductor drum 11 may be easily removed by the cleaning blade.

The fixing unit 7 may use a belt for fixing an image on a transfer sheet TS.

Although not shown in FIG. 1, the image forming apparatus 100 may further include a manual feed tray, a toner refill unit, a waste toner bottle, a sheet-face reversing unit, and/or a power unit, for example.

The optical writing unit 2 may include a light source, a polygon mirror, an f-theta lens, and a reflection mirror, for example. The optical writing unit 2 may irradiate a laser beam to scan a surface of the photoconductor drums 11Y, 11M, 11C, and 11K based on image data.

Figure 2:
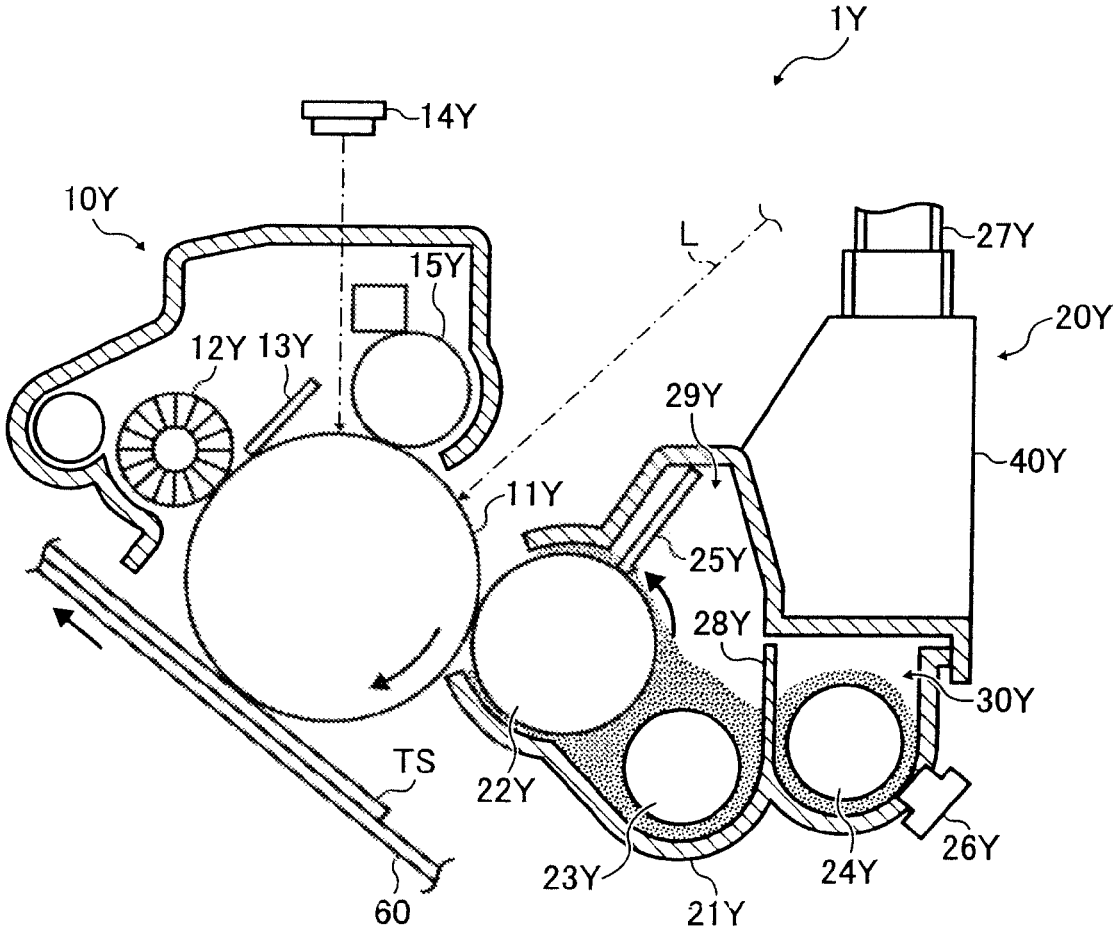
FIG. 2 is a schematic view of a developing unit of an image forming apparatus according to an exemplary embodiment.

FIG. 2 is a schematic expanded view of the developing unit 1Y. Because the developing units 1Y, 1M, 1C, and 1K may all have a similar configuration, the developing unit 1Y may be representatively used for explaining developing units 1Y, 1M, 1C, and 1K, hereinafter.

As shown in FIG. 2, the developing unit 1Y may include a photoconductor unit 10Y, and a developer unit 20Y, for example.

The photoconductor unit 10Y may include a photoconductor drum 11Y, a brush roller 12Y, a counter blade 13Y, a de-charging lamp 14Y, and a charging roller 15Y, for example.

The brush roller 12Y may apply a lubricant agent on a surface of the photoconductor drum 11Y. The counter blade 13Y may be used to adjust a thickness of the lubricant agent on the surface of the photoconductor drum 11Y.

The de-charging lamp 14Y may de-charge the surface of the photoconductor drum 11Y.

The charging roller 15Y may charge the surface of the photoconductor drum 11Y uniformly.

The photoconductor drum 11Y may have a surface layer having an organic photoconductor (OPC), for example.

In the photoconductor unit 10Y, the charging roller 15Y applied with an alternating voltage may uniformly charge the surface of the photoconductor drum 11Y.

The optical writing unit 2 (see FIG. 1) may scan a laser beam L to the surface of photoconductor drum 11Y to form an electrostatic latent image on the photoconductor drum 11Y, wherein the laser beam L may be modulated based on image data and deflected by an optical element such as a mirror.

As shown in FIG. 2, the developer unit 20Y may include a casing 21Y, a developing roller 22Y, a first transport screw 23Y, a second transport screw 24Y, a doctor blade 25Y, a T-sensor 26Y, and a powder pump 27Y, for example.

As shown in FIG. 2, the casing 21Y may have an opening, through which a part of the developing roller 22Y may be faced and exposed to the photoconductor drum 11Y.

The T-sensor 26Y may be used to detect a toner ratio in the developer unit 20Y.

The developer unit 20Y may further include an image developer cartridge 40Y, which may contain fresh image developer for refilling the image developer.

The casing 21Y may contain an image developer having magnetic carrier particles and toner particles. The toner particles may be charged to a negative potential, for example.

The first transport screw 23Y and second transport screw 24Y may agitate and transport the image developer in the casing 21Y to give a charging potential to the image developer with an effect of friction between the transport screw and the image developer.

Such image developer may be carried onto a surface of the developing roller 22Y, which may carry the image developer.

The doctor blade 25Y may regulate a thickness of the image developer on the developing roller 22Y.

The developing roller 22Y may transport the image developer to a portion facing the photoconductor drum 11Y so that toner particles may be adhered to an electrostatic latent image formed on the photoconductor drum 11Y.

With such a developing process, a toner image may be formed on the photoconductor drum 11Y.

The image developer, which may consume toner particles during such a developing process, may be returned to the casing 21Y with a rotational movement of the developing roller 22Y.

As shown in FIG. 2, a separation wall 28Y may be provided in the casing 21Y to separate a first supply section 29Y and a second supply section 30Y.

The first supply section 29Y may include the developing roller 22Y and the first transport screw 23Y, for example.

The second supply section 30Y may include the second transport screw 24Y, for example.

The toner image developed on the photoconductor drum 11Y may be transferred to the transfer sheet TS transported by a transfer belt 60 (to be described later).

The first transport screw 23Y, rotated by a driver (not shown), may transport the image developer in a given direction in the first supply section 29Y that is parallel to the developing roller 22Y, and may supply the image developer to the developing roller 22Y during such transportation.

Figure 3:
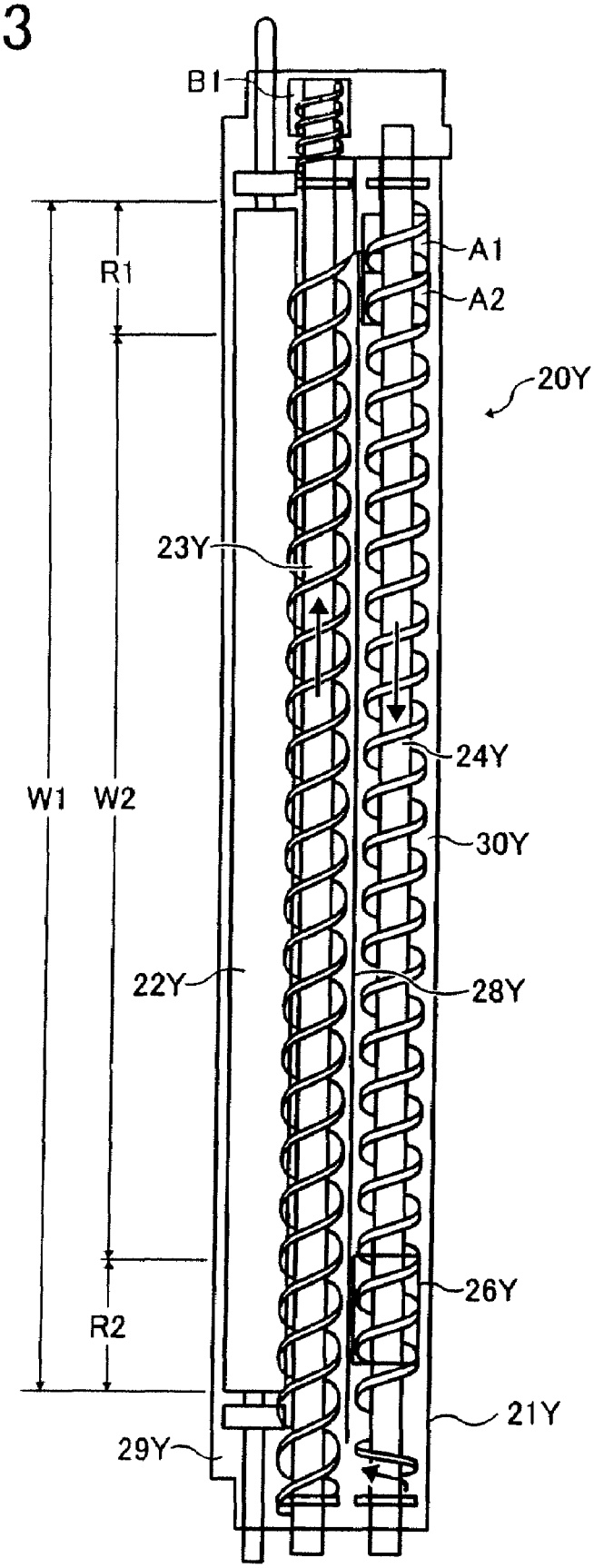
FIG. 3 is a schematic top view of the developing unit of FIG. 2.

FIG. 3 shows a schematic internal configuration of the developer unit 20Y, which is viewed from a topside of the developer unit 20Y.

As shown in FIG. 3, the first supply section 29Y and second supply section 30Y may communicate with each other at a communication port provided in an each end portion of the separation wall 28Y.

When the first transport screw 23Y transports an image developer to one end portion of the first supply section 29Y, the image developer may enter the second supply section 30Y through one of the communication ports.

If an amount or height of the image developer exceeds a given level, the excess amount of image developer may be guided to a drain port B1, and recovered to a waste bottle (not shown).

The second transport screw 24Y, rotated by a driver (not shown), may transport the image developer entered from the first supply section 29Y into a given direction in the second supply section 30Y.

In an exemplary embodiment, the first transport screw 23Y and second transport screw 24Y may transport the image developer in opposite directions to each other so that the image developer may be circulated in the casing 21Y.

When the second transport screw 24Y transports the image developer to an end portion of the second supply section 30Y, the image developer may return into the first supply section 29Y through the other communication port.

The T-sensor 26Y may include a magnetic permeability sensor, for example. The T-sensor 26Y may be provided on a bottom wall of the second supply section 30Y, and may detect magnetic permeability of the image developer passing over the T-sensor 26Y and may output a voltage signal corresponding to the detected magnetic permeability.

A magnetic permeability of the image developer may have a correlation with a toner ratio in the image developer, thereby the T-sensor 26Y may output a voltage signal corresponding to the toner ratio in the image developer.

Figure 4:
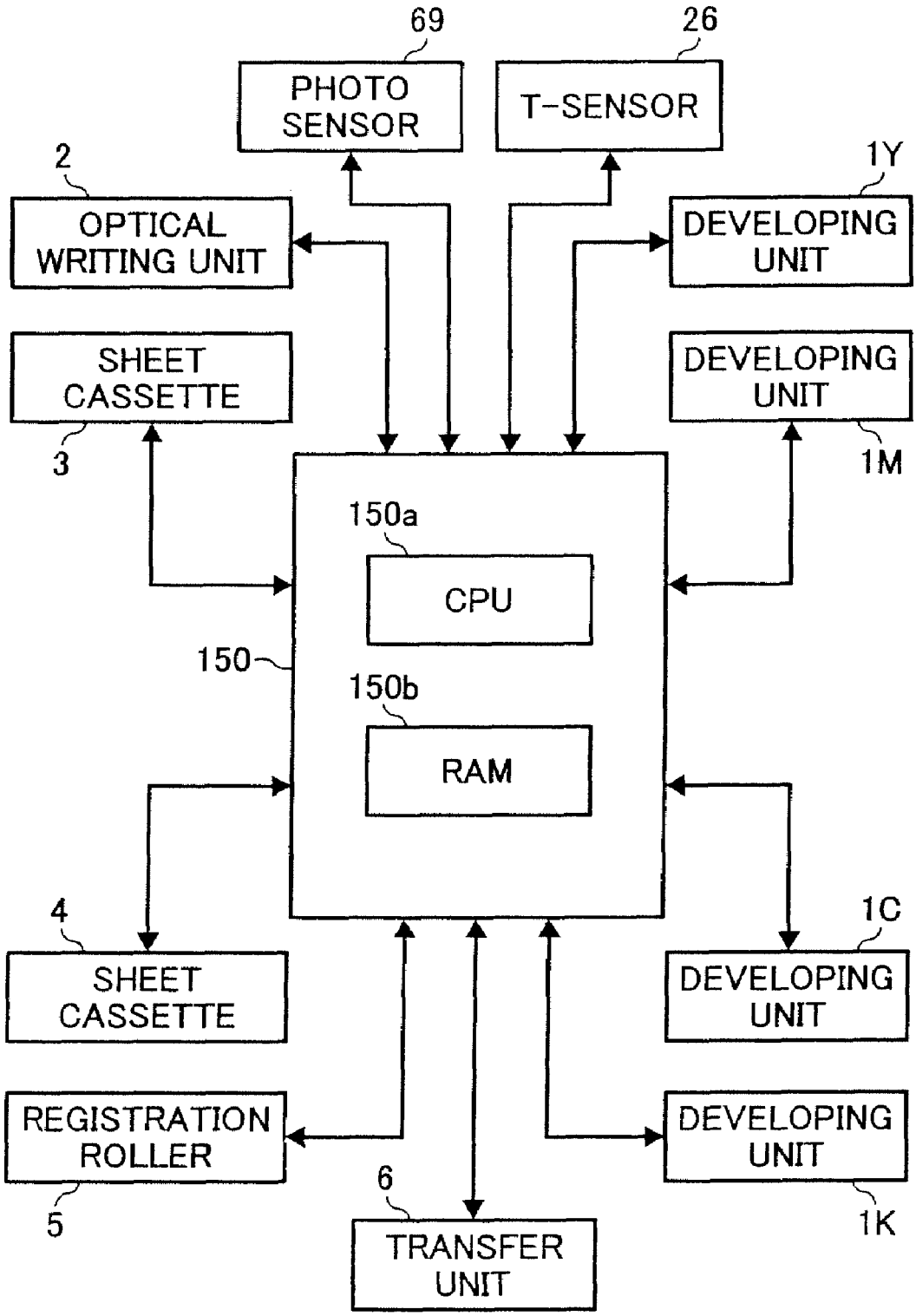
FIG. 4 is a block diagram for an electric circuit in the image forming apparatus of FIG. 1.

The T-sensor 26Y may transmit the output voltage value to a controller 150 shown in FIG. 4.

The controller 150 shown in FIG. 4 may include a RAM (random access memory) 150*b*, which may store a reference voltage value Vtref for Y as data, which may be compared with an actual output voltage transmitted from the T-sensor 26Y. "Vtref for Y" means a reference voltage for yellow toner, which may be used as a reference voltage for setting an image forming condition.

The RAM 150*b* may store reference voltage values Vtref for M, Vtref for C, and Vtref for K as data, which may be compared with actual output voltages transmitted from the T-sensors 26M, 26C, or 26K provided in developing unit 1.

Based on a comparison of an voltage value transmitted from the T-sensor 26Y and Vtref for Y for the developer unit 20Y, the powder pump 27Y (shown in FIG. 5), connected to the toner cartridge 9Y (shown in FIG. 5), may be driven for a given time period.

With such a process, toner particles may be supplied to the second supply section 30Y from the toner cartridge 9Y.

As mentioned above, toner particles in the image developer may be consumed during a developing process, by which a toner ratio in the image developer may become smaller.

When the powder pump 27Y is controlled for refilling toner particles, a given amount of toner particles may be supplied or refilled into the second supply section 30Y via a toner supply port A1 shown in FIG. 3.

Accordingly, a toner ratio of the image developer in the first supply section 29Y may be maintained within a given range.

Such refilling control may be similarly conducted for the developer units 20M, 20C, and 20K.

The image developer cartridge 40Y shown in FIG. 2 may have fresh image developer therein. An amount of fresh image developer contained in the image developer cartridge 40Y and an initial amount of image developer in the casing 21Y may be a substantially equal amount, for example.

An amount of fresh image developer to-be-refilled into the casing 21Y may be determined with a method, to be described later, and may be supplied into the second supply section 30Y at a given timing through a refill port A2 shown in FIG. 3.

Furthermore, the photoconductor drum 11Y, 11M, 11C, and 11K may contact a transfer belt 60 in the transfer unit 6 to form a transfer nip between the photoconductor drum 11Y, 11M, 11C, 11K and transfer belt 60.

Figure 6:
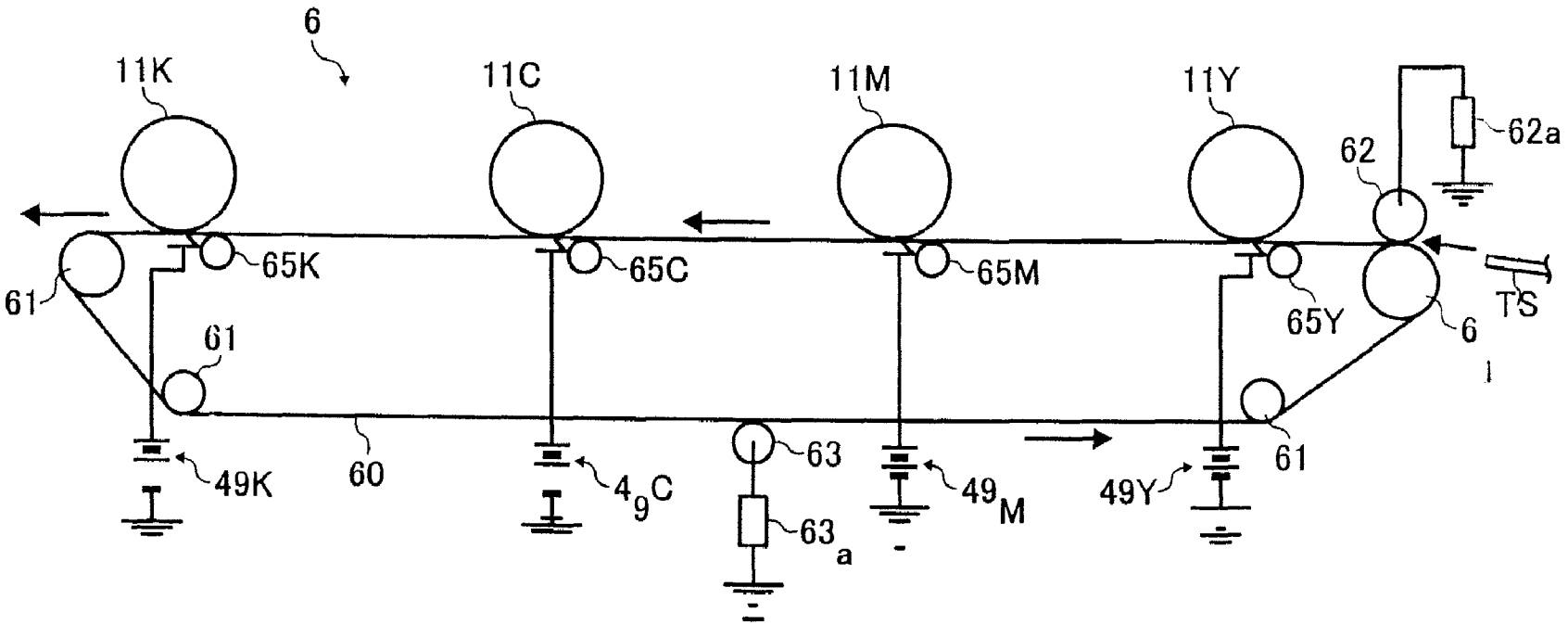
FIG. 6 is a schematic view of a transfer unit in the image forming apparatus of FIG. 1.

FIG. 6 is a schematic expanded view of the transfer unit 6 having the transfer belt 60.

The transfer belt 60 may be an endless type belt having a higher volume resistivity (e.g., $10^9$ Ωcm to $10^{11}$ Ωcm), and may be made of a material such as PVDF (polyvinylidene).

Four support rollers 61 may extend such a transfer belt 60. One of the support rollers 61 (i.e., right end side in FIG. 6) may face an adsorption roller 62 applied with a given voltage from a power source 62*a* shown in FIG. 6.

The registration roller 5 (shown in FIG. 1) may feed the transfer sheet TS to a space between the support roller 61 and adsorption roller 62, by which the transfer sheet TS may be electrostatically adhered to the transfer belt 60.

One of the support rollers 61 (i.e., left end side in FIG. 6) may be rotated by a driver (not shown) to frictionally move the transfer belt 60.

As shown in FIG. 6, a bias roller 63, applied with a given cleaning bias voltage from a power source 63*a*, may contact the transfer belt 60.

At each of transfer nips, transfer bias applying members 65Y, 65M, 65C, and 65K may be contactingly provided on an inner face of the transfer belt 60.

Such transfer bias applying members 65Y, 65M, 65C, and 65K may include a brush made of mylar plastic, which may be applied with a transfer bias from transfer bias voltage sources 49Y, 49M, 49C, and 49K, respectively.

With such a transfer bias applying member 65, the transfer belt 60 may be applied with a transfer voltage, by which a transfer electric-field having a given potential may be generated at a transfer nip defined by the transfer belt 60 and surface of the photoconductor drum 11.

Figure 7:
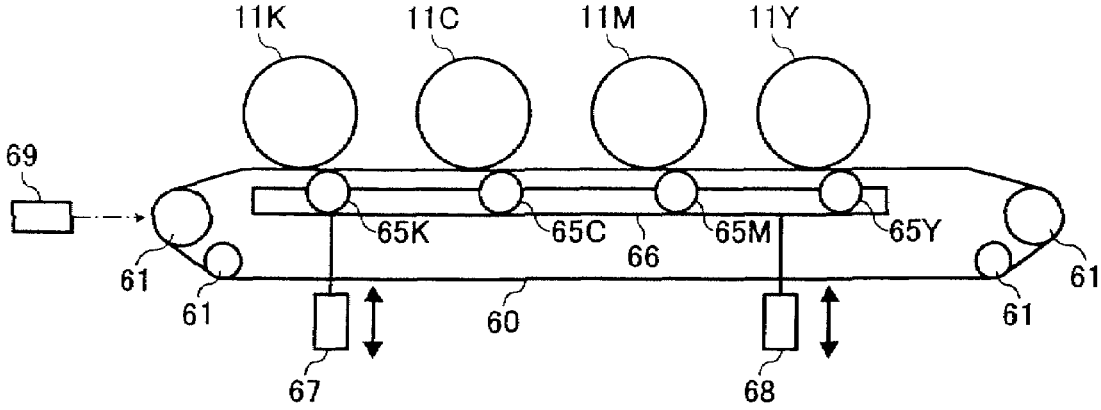
FIG. 7 is a schematic view of a transfer unit and a transfer-pressure adjusting unit.

FIG. 7 is a schematic view of the transfer unit 6 for explaining a transfer-pressure adjusting unit.

As shown in FIG. 7, each of the transfer bias applying members 65Y, 65M, 65C, and 65K may be supported by a supporter 66, and the supporter 66 may be supported by solenoids 67 and 68.

The transfer bias applying members 65Y, 65M, 65C, and 65K may be rotationally moveable on the supporter 66.

When the solenoids 67 and 68 are activated, the transfer bias applying members 65Y, 65M, 65C, and 65K may be moved in an up or down direction, by which a contact pressure (or nip pressure) at the transfer nip defined by the photoconductor drum 11 and transfer belt 60 may be adjusted.

When superimposing transfer toner images of different colors, the transfer belt 60 may be pressed toward the photoconductor drums 11Y, 11M, 11C, and 11K with a given contact pressure value.

In FIG. 1, a chain line may indicate a transportation route of the transfer sheet TS.

The transfer sheet TS (not shown in FIG. 1) fed from the sheet cassettes 3 and 4 may be guided and transported by a transport guide (not shown) and a transportation roller to the registration roller 5, where the transfer sheet TS may be stopped temporally.

The registration roller 5 may feed the transfer sheet TS at a given timing onto the transfer belt 60.

The transfer sheet TS on the transfer belt 60 may contactingly pass through the transfer nips for the developing unit 1Y, 1M, 1C, and 1K.

A toner image formed on each of the photoconductor drums 11Y, 11M, 11C, and 11K may be superimposed and transferred to the transfer sheet TS with an effect of the transfer electric-field and nip pressure, by which a full color toner image may be formed on the transfer sheet TS.

After transferring the toner image from the photoconductor drum 11Y to the transfer sheet TS, the brush roller 12Y may apply a given amount of lubricant agent on the photoconductor drum 11Y, then the counter blade 13Y may smooth a thickness of the lubricant agent on the photoconductor drum 11Y, and the de-charging lamp 14Y may irradiate a light beam to de-charge the photoconductor drum 11Y.

With such processes, the photoconductor drum 11Y may be ready for a next image forming operation.

The transfer sheet TS having the full color toner image thereon may be transported to the fixing unit 7 (see FIG. 1), in which the full color toner image may be fixed on the transfer sheet TS with an effect of a heat roller, and then the transfer sheet TS may be ejected to the sheet ejection tray 8. The fixing unit 7 may include a temperature sensor (not shown) to detect a temperature of the heat roller, for example.

FIG. 4 is a block diagram of an electric circuit used in the image forming apparatus 100, which may include a controller 150.

The controller 150 may be connected to the developing unit 1Y, 1M, 1C, and 1K, optical writing unit 2, sheet cassettes 3 and 4, registration roller 5, transfer unit 6, reflection type photosensor 69, and T-sensor 26, for example. The controller 150 may control such units and devices.

The controller 150 may include a CPU (central processing unit) 150*a*, and a RAM (random access memory) 150*b*, for example. The CPU 150*a* may conduct arithmetic processing or computation, and the RAM 150*b* may store data.

The RAM 150*b* may store data such as a developing bias voltage value for developing units 1Y, 1M, 1C, and 1K, and a drum charging voltage value for photoconductive drums 11Y, 11M, 11C, and 11K, for example.

During an image forming process, the controller 150 may control a charging bias voltage to be supplied to each of the charging rollers 15Y, 15M, 15C, and 15K, which may apply a drum charging voltage to the photoconductive drums 11Y, 11M, 11C, and 11K, respectively.

With such a control operation, each of the photoconductor drums 11Y, 11M, 11C, and 11K may be uniformly charged with its respective drum charging voltage.

The controller 150 may also control a developing bias voltage to be supplied to each of the developing rollers 22Y, 22M, 22C, and 22K.

The controller 150 may instruct a test operation for image forming performance of the developing unit 1 at a given condition.

Such a condition may include a condition when a heat roller temperature is lower than a given temperature (e.g., 60 degree Celsius) when a main power source (not shown) is set to ON, and a condition when image forming operations are conducted for a given number of times.

Such a condition may have threshold values, which may be settable by a service person or user. For example, a service person or user may operate an operation panel, a printer driver of a PC (personal computer) or a printer. Such threshold values may be settable within a given range.

Table 1 shows a list of example conditions for controlling the developing unit 1. Hereinafter, such a test operation may be termed a "self check operation," as required.

TABLE 1

| | | High quality mode | Normal quality mode | Speed mode |
|---|---|---|---|---|
| Image concentration control | Threshold value of heat roller when power is ON | None | 60 degrees Celsius | 40 degrees Celsius |
| | Threshold value of temperature and humidity | None | 23 degrees Celsius 60% or more | 27 degrees Celsius 80% or more |
| | Threshold value of number of printed sheets | 100 | 200 | 300 |
| Image positional deviation control | Threshold value of temperature | none | 5 degrees Celsius | 10 degrees Celsius |
| | Threshold value of number of printed sheets | 100 | 200 | 300 |

The controller 150 may instruct a test operation for image forming performance of the developing unit 1 as discussed below.

Specifically, the photoconductor drum 11Y, 11M, 11C, and 11K, rotating in a given direction, may be charged.

During such a charging process, a charging voltage may be gradually increased to a negative polarity side, which may be different from a uniform charging during a normal image forming process.

A reference image may be formed on the photoconductor drums 11Y, 11M, 11C, and 11K as latent images by scanning a laser beam on the photoconductor drums 11Y, 11M, 11C, and 11K, and then the developing units 20Y, 20M, 20C, and 20K may develop the electrostatic latent images on the photoconductor drums 11Y, 11M, 11C, and 11K.

With such a developing process, reference images Py, Pm, Pc, and Pk (shown in FIG. 12, for example) may be formed on the photoconductor drum 11Y, 11M, 11C, and 11K, respectively.

During such a developing process, the controller 150 may control a developing bias voltage applied to the developing rollers 22Y, 22M, 22C, and 22K by gradually increasing a bias voltage value to a negative polarity side.

The above-mentioned test operation for image forming performance may not be conducted when a heat roller temperature already exceeds a given temperature (e.g., 60 degrees Celsius) when the main power source is set to ON.

If a time interval from an "OFF" to an "ON" condition of the main power source is relatively smaller (e.g., several minutes, ten minutes, twenty minutes or so), the above-mentioned test operation for image forming performance may be omitted.

Such an omission may be preferable from a viewpoint of reducing a waiting time of a user, and reducing power consumption or toner particles consumption.

Figure 8:
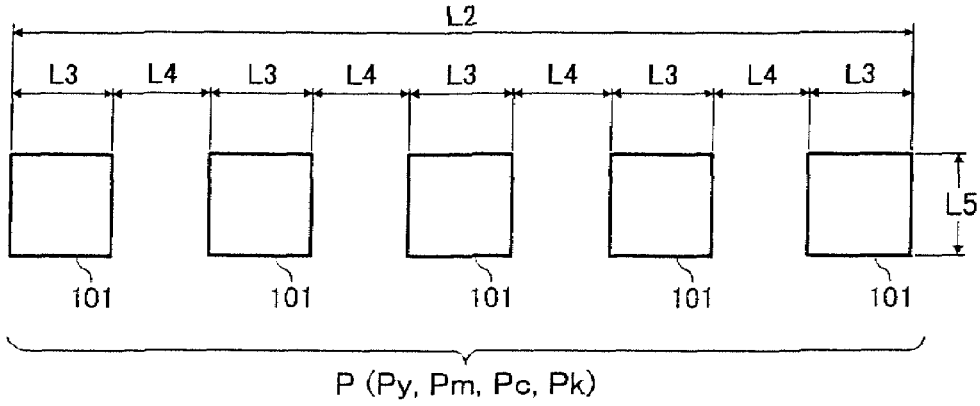
FIG. 8 is a schematic view of a reference image pattern.

FIG. 8 is a schematic view showing a reference image pattern P (e.g., Py, Pm, Pc, and Pk), in which a reference image pattern P may include a plurality of reference images 101.

For example, as shown in FIG. 8, the reference image pattern P may include five reference images 101 having an interval between L4 each other.

The reference image 101 may have a rectangular shape having a length L3 and a width L5 as shown in FIG. 8, for example.

For example, the reference image 101 may be set to 20 mm for L3 and 15 mm for L5, and 10 mm for L4. In such a case, a length L2 of the reference image pattern P on the transfer belt 60 may become 140 mm (i.e., 20×5+10×4=140 mm).

The reference image patterns Py, Pm, Pc, and Pk may not be superimposed on each other on the transfer belt 60, which may be different from a normal image forming process superimposing a plurality of toner images for producing a full color image.

With such a transfer process, a pattern block PB configured with reference image patterns Py, Pm, Pc, and Pk may be formed on the transfer belt 60.

Figure 9:
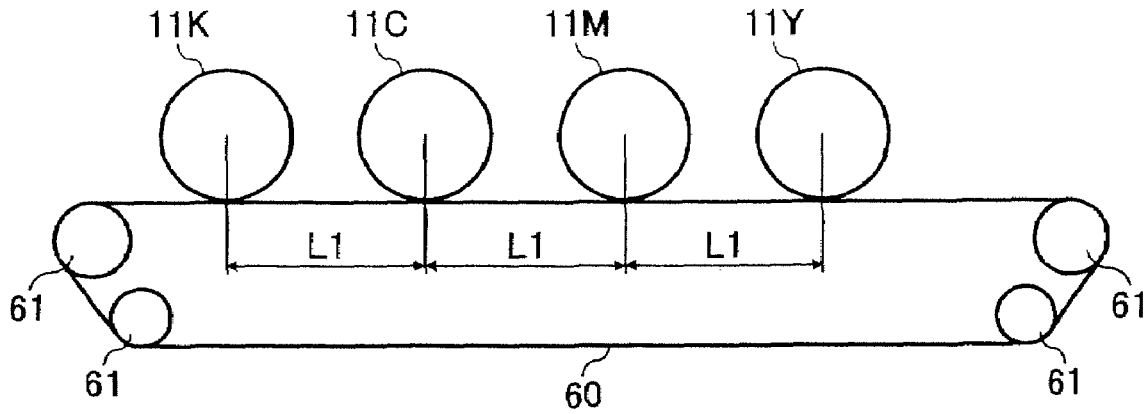
FIG. 9 is a schematic view of photoconductor drums arranged with a given pitch.

FIG. 9 is a schematic view for explaining an interval pitch of the photoconductor drum 11.

As shown in FIG. 9, the photoconductor drums 11Y, 11M, 11C, and 11K may be provided with an interval pitch L1. For example, the image forming apparatus 100 may have 200 mm for the interval pitch L1.

As above-mentioned, reference image patterns Py, Pm, Pc, and Pk may have the length L2 of 140 mm, which may be shorter than the interval pitch L1 (e.g., 200 mm) for the photoconductor drum 11.

Therefore, each of the reference image patterns Py, Pm, Pc, and Pk may be transferred to the transfer belt 60 while not superimposing an end portion of the reference image patterns Py, Pm, Pc, and Pk with each other.

Figure 10:
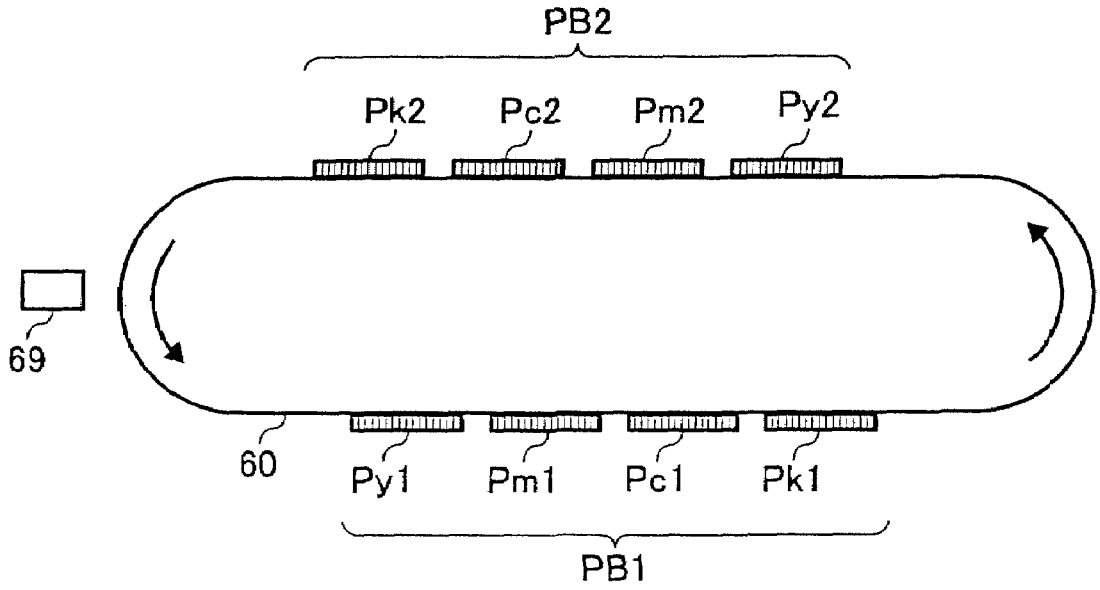
FIG. 10 is a schematic view of a transfer belt having a pattern block thereon.

FIG. 10 is a schematic view of a pattern block PB formed on the transfer belt 60.

For example, two pattern blocks PB may be formed on the transfer belt 60, wherein each of the pattern blocks PB may include reference image patterns Pk, Pc, Pm, and Py.

Specifically, a first pattern block PB1 including reference image patterns Pk1, Pc1, Pm1, and Py1, and a second pattern block PB2 including reference image patterns Pk2, Pc2, Pm2, and Py2, may be formed on the transfer belt 60. Such first and second pattern blocks PB1 and PB2 may be formed as discussed below.

At first, the first pattern block PB1 having reference image patterns Pk1, Pc1, Pm1, and Py1 may be transferred to the transfer belt 60 at a first timing.

Then, the reference image pattern Py1, which may be a rear end image in the first pattern block PB1, may pass through the transfer nip of the photoconductor drum 11K at a second timing.

During a time from the first timing to second timing, the controller 150 may control a transfer pressure at a given value by controlling the solenoids 67 and 68 (see FIG. 7) of the transfer unit 6.

Specifically, the controller 150 may control the solenoids 67 and 68 so that the transfer pressure is reduced until the reference image pattern Py1 passes through the transfer nip of the photoconductor drum 11K at the second timing.

With such a reduction of transfer pressure, a reverse-transfer of the reference image patterns Pc1, Pm1, and Py1 to the photoconductor drums 11 at the transfer nips may be suppressed, and such reference image patterns Pc1, Pm1, and Py1 may move with the transfer belt 60.

The reverse-transfer of the reference image pattern is a phenomenon wherein that the reference image pattern, transferred on the transfer belt 60, is transferred to the photoconductor drum 11.

Accordingly, the reference image patterns Pc1, Pm1, and Py1 in the first pattern block PB1 may have a given concentration value while suppressing a reverse-transfer of the image to the photoconductor drum 11.

The controller 150 may further instruct a forming of reference image patterns Pk2, Pc2, Pm2, and Py2 for the second pattern block PB2 on the photoconductor drums 11Y, 11M, 11C, and 11K at a third timing.

Such a third timing may be determined as a timing when the reference image patterns Pk2, Pc2, Pm2, and Py2 for the second pattern block PB2 are started to be transferred to the transfer belt 60 after the reference image pattern Py1, which is at the rear end in the first pattern block PB1, passes through the transfer nip of the photoconductor drum 11K at the second timing, and moves for some distance from the transfer nip of the photoconductor drum 11K.

During a time from the second timing to third timing, the controller 150 may control a transfer pressure at a given value by controlling the solenoids 67 and 68 (see FIG. 7) of the transfer unit 6.

Specifically, the controller 150 may control the solenoids 67 and 68 so that the transfer pressure is increased to an original pressure before the reference image pattern P for second pattern block PB2 is transferred to the transfer belt 60 at the third timing.

By increasing transfer pressure as such, the reference image pattern P for the second pattern block PB2 may be favorably transferred to the transfer belt 60.

Furthermore, similarly to the first pattern block PB1, the controller 150 may control the solenoids 67 and 68 so that a reverse-transfer of the reference image pattern P of second pattern block PB2 to the photoconductor drum 11 may be suppressed.

The first pattern block PB1 and second pattern block PB2 may include reference image patterns Py, Pm, Pc, and Pk, and, furthermore, each of the reference image patterns Py, Pm, Pc, and Pk may include five reference images 101, for example.

Therefore, a number of reference images 101 formed for each color of Y, M, C, and K may become ten reference images (i.e., 5×2=10).

The ten reference images 101 for each color Y, M, C, and K may be formed on the photoconductor drum 11 with conditions shown in Table 2 below.

An intensity of the laser beam may be set to a given value so that an electrostatic latent image for forming reference image 101 may have a given voltage (e.g., −20V) without depending on a drum charging voltage value.

TABLE 2

| Reference image | Drum charging voltage (−V) | Developing bias voltage (−V) |
|---|---|---|
| (1) | 350 | 100 |
| (2) | 370 | 120 |
| (3) | 390 | 140 |
| (4) | 410 | 160 |
| (5) | 430 | 180 |
| (6) | 450 | 200 |
| (7) | 490 | 240 |
| (8) | 530 | 280 |
| (9) | 570 | 320 |
| (10) | 810 | 560 |

In Table 2, conditions (1) to (10) may correspond to each of the reference images 101 formed in the first pattern block PB1 and second pattern block PB2.

For example, condition (1) may be a reference image 101 formed at a front end of the first pattern block PB1, and condition (10) may be a reference image 101 formed at a rear end of the second pattern block PB2.

Accordingly, reference images 101 corresponding to conditions (1) to (5) may be formed in the first pattern block PB1, and reference images 101 corresponding to conditions (6) to (10) may be formed in the second pattern block PB2, for example.

As shown in Table 2, in the developing unit 1Y, 1M, 1C, and 1K of the image forming apparatus 100, reference images 101 corresponding to conditions (1) to (10) may be formed by gradually changing a drum charging voltage and developing bias voltage to a lower value in a negative polarity side.

Because each of the reference images 101 may be developed with a developing potential changed gradually as such, the reference images 101 formed under conditions shown in Table 2 may have different image concentrations from each other.

In Table 2, a developing potential may become higher for the latter reference images 101, and thereby an image concentration for the latter reference images 101 may become higher.

Such developing potential is defined as a potential difference between a latent image voltage and a developing bias voltage.

Figure 11:
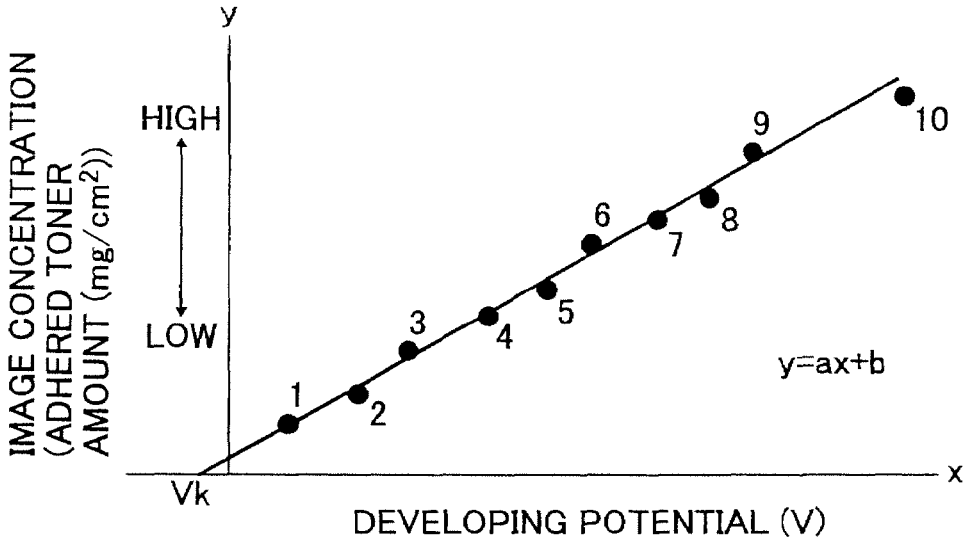
FIG. 11 is graph showing a relationship between an image concentration and developing potential.

FIG. 11 shows a graph explaining a relationship between a developing bias voltage and an image concentration of reference images 101, corresponding to conditions (1) to (10) in Table 2.

As shown in FIG. 11, the graph has a straight line, on which the above-mentioned conditions (1) to (10) may be substantially included.

As can be seen on a graph in FIG. 11, the developing potential (or developing bias voltage) and image concentration may have a positive correlation to each other, wherein the image concentration may mean an amount of toner adhered on a unit area on a transfer sheet.

The straight line shown in FIG. 11 may be expressed as a function of "y=ax+b." Based on such a function, a developing potential (or developing bias voltage) for a desired image concentration may be computed.

Figure 12:
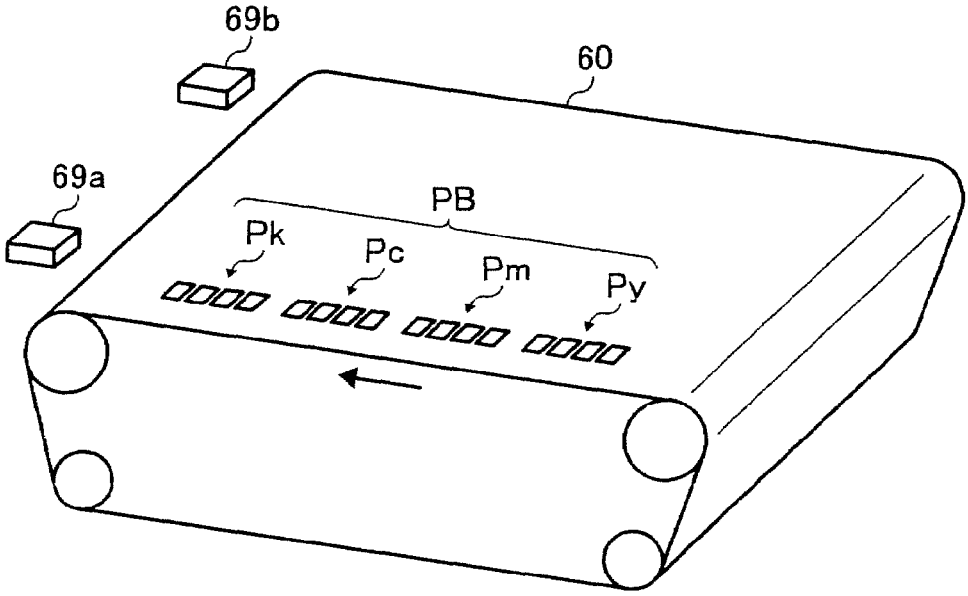
FIG. 12 is a schematic perspective view showing a transfer belt and a reflection type photosensor.

FIG. 12 is a schematic perspective view of the transfer belt 60 and the reflection type photosensor 69.

As shown in FIG. 12, the image forming apparatus 100 may include two reflection type photosensors 69*a* and 69*b*. Hereinafter, the reflection type photosensor may be termed a "photosensor" for simplicity of expression.

The first pattern block PB1 and second pattern block PB2 may be formed on each lateral side of the transfer belt 60.

The photosensor 69*a* may detect the first pattern block PB1 or the second pattern block PB2.

Such lateral side of the transfer belt 60 may correspond to an end area R1 or R2 of the developing roller 22Y (see FIG. 3).

In FIG. 3, an effective width W2 of the developing roller 22Y may correspond to a width of transfer sheet (not shown), and a total width W1 may include the effective width W2 and the end areas R1 and R2.

The end area R2 may be provided to an upstream side of a transportation direction of image developer in the first supply section 29Y, and the end area R1 may be provided to a downstream side of a transportation direction of image developer in the first supply section 29Y.

In a normal image forming process, image developer existing in the end area R2 or R1 of the developing roller 22Y may not be used for the developing process.

Image developer existing in the end area R2 of the developing roller 22Y in the first supply section 29Y may have a toner ratio, controlled within a given range by the above-explained refilling operation for toner particles.

Therefore, even if the reference image pattern Py may be developed after producing images having a higher image area ratio continuously, such a reference image pattern Py may be developed with the image developer having a normal toner ratio. The image having a higher image area ratio may include a solid image, photo image, or the like.

Similarly, other reference image patterns Pm, Pc, and Pk may be developed with the image developer having a normal toner ratio.

Figure 13:
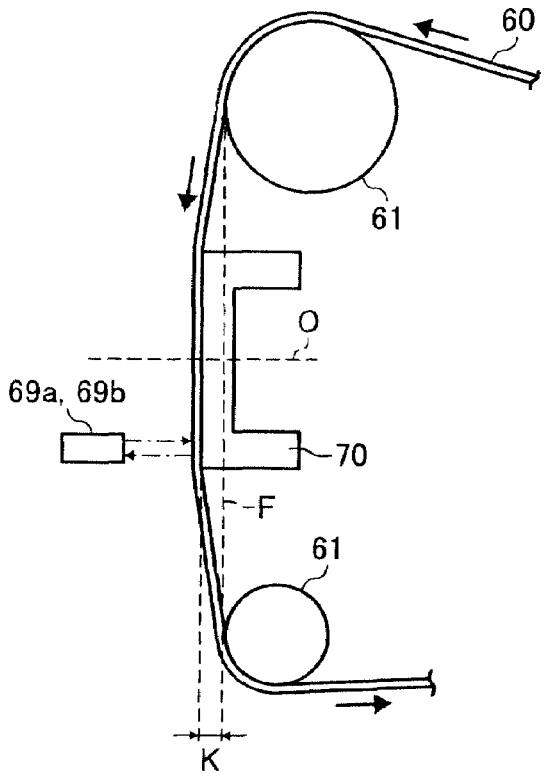
FIG. 13 is an schematic view showing a positional relationship of a photosensor and a transfer belt.

FIG. 13 is a schematic configuration of the photosensors 69*a* and 69*b* and the transfer belt 60.

As shown in FIG. 13, a reflection member 70 may contact an inner face of the transfer belt 60. The reflection member 70 may be made of a base material (e.g., stainless steel) and a coating layer (e.g., Ni coating, Cr coating) coating the base material, for example.

The reflection member 70 may support the transfer belt 60 from an inner face side of the transfer belt 60 as shown in FIG. 13. If the reflection member 70 does not support the transfer belt 60, the transfer belt 60 may move along a chain line F shown in FIG. 13.

The reflection member 70 may bias the transfer belt 60 by a distance K (e.g., 1 mm to 2 mm), for example.

The reflection member 70 may have a flat face, finished as a mirror face, which may reflect a light beam effectively. The reflection member 70 may contact the transfer belt 60 via the flat face.

The photosensors 69*a* and 69*b*, and the reflection member 70 may be an image detector, which may detect an image pattern or an image formed on the transfer belt 60.

Because the image pattern or the image may be formed with toner particles, such an image detector may detect an amount of toner adhered to the transfer belt 60.

Specifically, a light beam, passed through the transfer belt 60 and reflected by the reflection member 70, may be detected by the photosensors 69*a* and 69*b*.

As shown in FIG. 13, the reflection member 70 may face the photosensors 69*a* and 69*b* via the transfer belt 60.

The photosensors 69*a* and 69*b* may have a light emitter (not shown), which may emit a light beam. Such a light beam may pass through a transparent portion or translucent white portion of the transfer belt 60, and reach the reflection member 70.

Such a light beam may be reflected on the surface of the reflection member 70, and then such reflected light may pass through the transparent portion or translucent white portion of the transfer belt 60.

The photosensors 69*a* and 69*b* may have a light receiver (not shown), which may detect such reflected light.

Although the transfer belt 60 made of PVDF (polyvinylidene) may have a translucent white color as a whole, such a translucent white color may not become an obstacle for effectively passing through a light beam emitted from the light emitter, and receiving reflected light beam by the light receiver.

If an intensity of a reflected light beam is not enough for detecting an image concentration (or toner amount) on the transfer belt 60, the transfer belt 60 may be made of a transparent material.

Furthermore, the transfer belt 60 may set a limited area thereon so that a light beam for detecting an image concentration (or toner amount) may only pass through such a limited area.

In an exemplary embodiment, the reference image 101, transferred from the photoconductor drum 11 to the transfer belt 60 may be detected by such a configuration using the reflection member 70, and the photosensors 69*a* and 69*b*.

As mentioned above, the reference image 101 may be detected by using a light beam passed through the reference image 101 on the transfer belt 60.

The reference image 101 may also be detected by using a light beam reflected from the reference image 101 directly. However, such a method using a reflected light beam for detecting an image concentration of the reference image 101 may have some drawbacks. For example, an intensity of the reflected light beam may be unfavorably reduced if a distance of a light path becomes greater.

Accordingly, a method of using a passing light beam may be preferable for detecting an image concentration of the reference image 101.

In the above-mentioned configuration, the light emitter and light receiver may be integrally disposed in one casing of a photosensor (e.g., photosensors 69*a* and 69*b*).

Form a viewpoint of efficiency of maintenance work and layout freedom of the device, such a configuration integrally disposing the light emitter and light receiver in one casing may be preferable compared to a configuration having a light emitter and a light receiver in different casings, which may have a lower efficiency of maintenance work and layout freedom of the device.

Furthermore, as shown in FIG. 13, the reflection member 70 may support the transfer belt 60, by which a vibration of the transfer belt 60 may be suppressed.

Accordingly, the photosensors 69*a* and 69*b* may detect a light beam with a higher precision because of the suppression of the vibration of the transfer belt 60 by a supporting effect of the reflection member 70.

Furthermore, a belt portion of the transfer belt 60, supported by the reflection member 70, may have a flat shape because the reflection member 70 may have a flat face as shown in FIG. 13. In other words, the belt portion of the transfer belt 60, supported by the reflection member 70, may not have a curved face or waved face.

Accordingly, the photosensors 69*a* and 69*b* may detect a light beam with a higher precision.

Furthermore, a negative pressure unit (not shown) may not be used for suppressing a vibration of the transfer belt 60, which may be preferable from a viewpoint of reducing manufacturing costs and noise generation.

As shown in FIG. 13, the photosensors 69*a* and 69*b* may be disposed on a down stream side of a belt moving direction of the transfer belt 60 with respect to a center O of the reflection member 70.

Specifically, the photosensors 69*a* and 69*b* may preferably face an edge area of the reflection member 70, which may be on a down stream side of the belt moving direction.

A vibration of the transfer belt 60 may be effectively suppressed at such an edge area of the reflection member 70 compared to an edge area of the reflection member 70, which may be on an upper stream side of the belt moving direction.

As shown in FIG. 10, the reference image patterns Pk1, Pc1, Pm1, and Py1 are transferred onto the transfer belt 60. Such a reference image pattern P may be detected by the photosensor 69 with a movement of the transfer belt 60.

After the reference image pattern P is detected by the photosensor 69, the reference image pattern P may be transported to a position facing the bias roller 63 (see FIG. 6), at which the reference image pattern P may be electrostatically transferred to the bias roller 63, by which the reference image pattern P may be removed from the transfer belt 60.

The photosensor 69*a* may detect the first pattern block PB1, which may consist of the reference image patterns Pk1, Pc1, Pm1, and Py1 having reference images 101 with a light beam.

Specifically, the photosensor 69*a* may detect five reference images 101 in the reference image pattern Pk1, five reference images 101 in the reference image pattern Pc1, five reference images 101 in the reference image pattern Pm1, and five reference images 101 in the reference image pattern Py1 in this order.

During such a detection process, the photosensor 69*a* may output voltage signals, corresponding to an intensity of the light beam detected by the photosensor 69*a*, to the controller 150 sequentially.

The controller 150 may compute an image concentration (or toner amount) of each of the reference images 101 based on voltage signals transmitted from the photosensor 69*a*, and may store image concentration data of the reference images 101 to the RAM 150*b*.

Furthermore, the photosensor 69*a* may detect the second pattern block PB2, which may consist of the reference image patterns Pk2, Pc2, Pm2, and Py2 having reference images 101 with a light beam similarly to the first pattern block PB1.

Similarly to the first pattern block PB1, the controller 150 may compute an image concentration (or toner amount) of each of the reference images 101 based on voltage signals transmitted from the photosensor 69*a*, and may store image concentration data of reference images 101 to the RAM 150*b*.

The controller 150 may conduct a regression analysis for the image concentration data and developing bias voltage data for each color, and determine a function of a regression formula as shown in FIG. 11.

FIG. 11 shows one example function expressed with a straight line (e.g., y=ax+b) for the image concentration data and developing bias voltage for the reference images 101.

If a target value of the image concentration is assigned to such a function, the controller 150 may compute a developing bias voltage used for the target value of image concentration for Y, M, C, and K. Such a computed target value may be termed "corrected developing bias voltage" hereinafter.

The controller 150 may store corrected developing bias voltage for Y, M, C, and K in the RAM 150*b*. Furthermore, the RAM 150*b* may store image forming conditions as shown in Table 3, for example.

TABLE 3

| Drum charging voltage (−V) | Developing bias voltage (−V) |
|---|---|
| 350 | 100 |
| 370 | 120 |
| 390 | 140 |
| 410 | 160 |
| 430 | 180 |
| 450 | 200 |
| 470 | 220 |
| 490 | 240 |
| 510 | 260 |
| 530 | 280 |
| 550 | 300 |
| 570 | 320 |
| 590 | 340 |
| 610 | 360 |
| 630 | 380 |
| 650 | 400 |
| 670 | 420 |
| 690 | 440 |
| 710 | 460 |
| 730 | 480 |
| 750 | 500 |
| 770 | 520 |
| 790 | 540 |
| 810 | 560 |
| 830 | 580 |
| 850 | 600 |
| 870 | 620 |
| 890 | 640 |
| 910 | 660 |
| 930 | 680 |

For example, Table 3 includes thirty conditions having thirty developing bias voltages and thirty drum charging voltages as image forming conditions.

As above-mentioned, a developing bias voltage for a given image concentration (e.g., target value) can be computed by assigning a given image concentration (e.g., target value) to the above-mentioned function (see FIG. 11).

The controller 150 may select a developing bias voltage value, which may be closer to such a computed developing bias voltage for each of the developing units 1Y, 1M, 1C, and 1K from Table 3.

Based on the selected developing bias voltage, the controller 150 may determine a drum charging voltage from Table 3 for the selected developing bias voltage.

Such a determined drum charging voltage may be termed "corrected drum charging voltage" hereinafter.

The controller 150 may store such a corrected drum charging voltage for Y, M, C, and K to the RAM 150*b*.

After storing the corrected (or selected) developing bias voltage and corrected drum charging voltage to the RAM 150*b*, the controller 150 may re-set developing bias voltage data for Y, M, C, and K to the corrected (or selected) developing bias voltage obtained by the above-mentioned process.

The controller 150 may store such re-set developing bias voltage data for Y, M, C, and K, to the RAM 150*b*.

Furthermore, in a similar manner, the controller 150 may re-set the drum charging voltage to the corrected drum charging voltage for Y, M, C, and K, and may store such corrected drum charging voltage to the RAM 150*b*.

With such a correcting or re-setting process, image forming conditions for the image forming units 1Y, 1M, 1C, and 1K may be corrected or re-set to a condition corresponding to a desired image concentration.

The optical writing unit 2 shown in FIG. 1 may include a reflection mirror for reflecting a laser beam emitted from a light source for Y, M, C, and K.

Such a reflected laser beam may be guided to the photoconductor drums 11Y, 11M, 11C, and 11K, respectively.

Furthermore, the optical writing unit 2 may also include a mirror slanting unit (not shown), which may be positioned in a parallel manner with photoconductor drums 11Y, 11M, 11C, and 11K. The mirror slanting unit may slant the reflection mirror, as required.

Hereinafter, an image position adjusting control is explained. The controller 150 may conduct the image position adjusting control.

Figure 14:
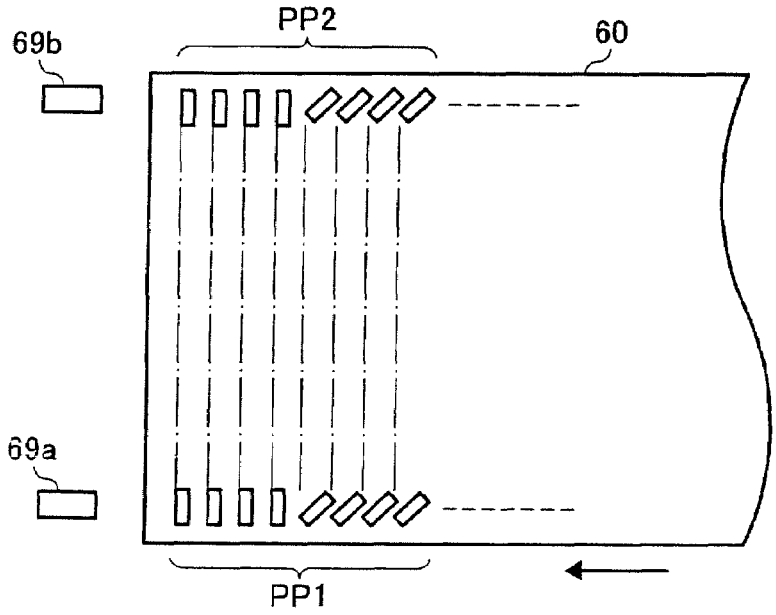
FIG. 14 is a schematic view of a reference image position for detecting an image deviation.

When conducting the image position adjusting control, reference image patterns PP1 and PP2 may be formed on the transfer belt 60 as shown in FIG. 14 for detecting a positional deviation of an image.

As shown in FIG. 14, the reference image pattern PP1 may be formed on one lateral portion of the transfer belt 60, and may be detected by the photosensor 69*a*, and the reference image pattern PP2 may be formed on another lateral portion of the transfer belt 60, and may be detected by the photosensor 69*b*.

Figure 15:
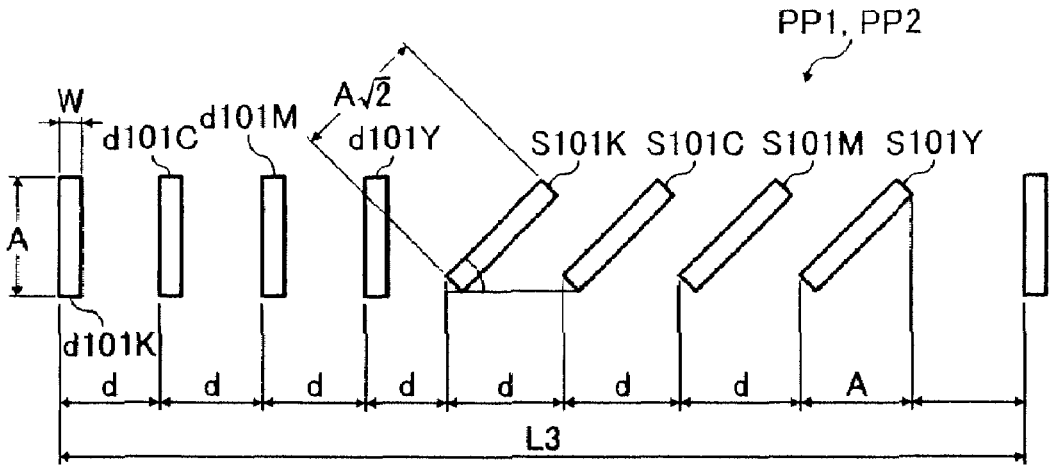
FIG. 15 is a schematic view of a reference image extending in a belt width direction and a reference image extending in a direction slanted from a belt width direction with an angle.

As shown in FIG. 15, each of the reference image patterns PP1 and PP2 may have reference images d101K, d101C, d101M, d101Y, S101K, S101C, S101M, and S101Y, for example.

The reference images d101K, d101C, d101M, and d101Y may have a longer side, extending in a belt width direction.

The reference images S101K, S101C, S101M, and S101Y may have a longer side, extending in a direction slanted from the belt width direction with an angle of 45°, for example.

In each of reference image patterns PP1 and PP2, reference images d101K, d101C, d101M, d101Y, S101K, S101C, S101M, and S101Y may be formed with a pitch "d."

Such reference image patterns PP1 or PP2 having the reference images d101K, d101C, d101M, d101Y, S101K, S101C, S101M, and S101Y may have a total length L3 as shown in FIG. 15.

As shown in FIG. 15, each of the reference images d101K, d101C, d101M, and d101Y may be formed with a length A and width W.

As shown in FIG. 15, each of the reference images S101K, S101C, S101M, and S101Y may be formed with a length $A\sqrt{2}$ and width W.

Furthermore, as shown in FIG. 15, the reference image pattern PP1 and PP2 may be formed on each lateral portion of the transfer belt 60.

Accordingly, the "reference images d101K, d101C, d101M, d101Y, S101K, S101C, S101M, and S101Y" of the reference image pattern PP1 and the "reference images d101K, d101C, d101M, d101Y, S101K, S101C, S101M, and S101Y" of the reference image pattern PP2 may correspond with each other in a belt width direction as schematically shown in FIG. 14.

In FIG. 14, it is assumed that an error condition may not occur when forming the reference images d101 and S101.

Such an error condition may include: assembly errors of the photoconductor drums 11, which may cause a slanting of the photoconductor drums 11; slanting of the reflection mirrors in the optical writing unit 2; and/or a deviation of drive timing of the polygon mirrors and light sources from a normal timing.

Under a normal condition, the reference images d101 and S101 may be formed with a substantially equal interval and parallel manner as shown in FIG. 14.

Such reference images d101 and S101 may be detected by photosensors 69*a* and 69*b* at substantially the same timing.

Figure 16:
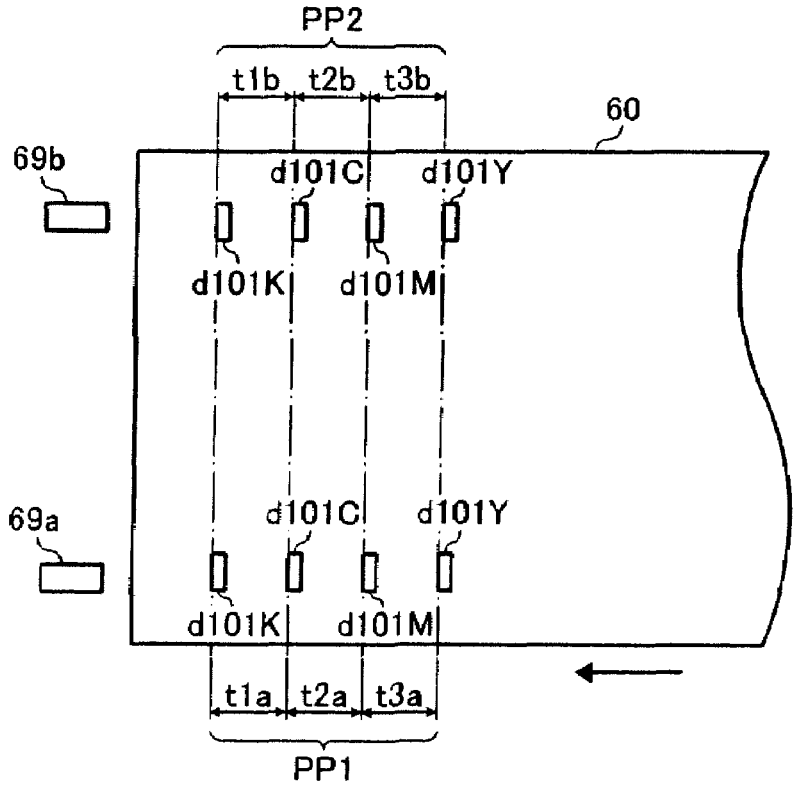
FIG. 16 is a schematic view of reference images having an equal detection interval.

Furthermore, if the reference images d101 and S101 are formed with a substantially equal interval and parallel manner, the photosensor 69*a* may detect reference images d101K, d101C, d101M, and d101Y of the reference image pattern PP1 with detection intervals of t1*a*, t2*a*, and t3*a* having a substantially equal interval as shown in FIG. 16.

The detection interval of t1*a* may mean a time starting from a detection of reference image d101K until a detection of reference image d101C.

The detection interval of t2*a* may mean a time starting from a detection of reference image d101C until a detection of reference image d101M.

The detection interval of t3*a* may mean a time starting from a detection of reference image d101M until a detection of reference image 101Y.

Furthermore, the photosensor 69*b* may detect reference images d101K, d101C, d101M, and d101Y of the reference image pattern PP2 at a substantially same timing when the photosensor 69*a* detects the reference image pattern PP1.

Accordingly, the photosensor 69*b* may detect reference images d101K, d101C, d101M, and d101Y with detection intervals of t1*b*, t2*b*, and t3*b* having a substantially equal interval as shown in FIG. 16.

Figure 17:
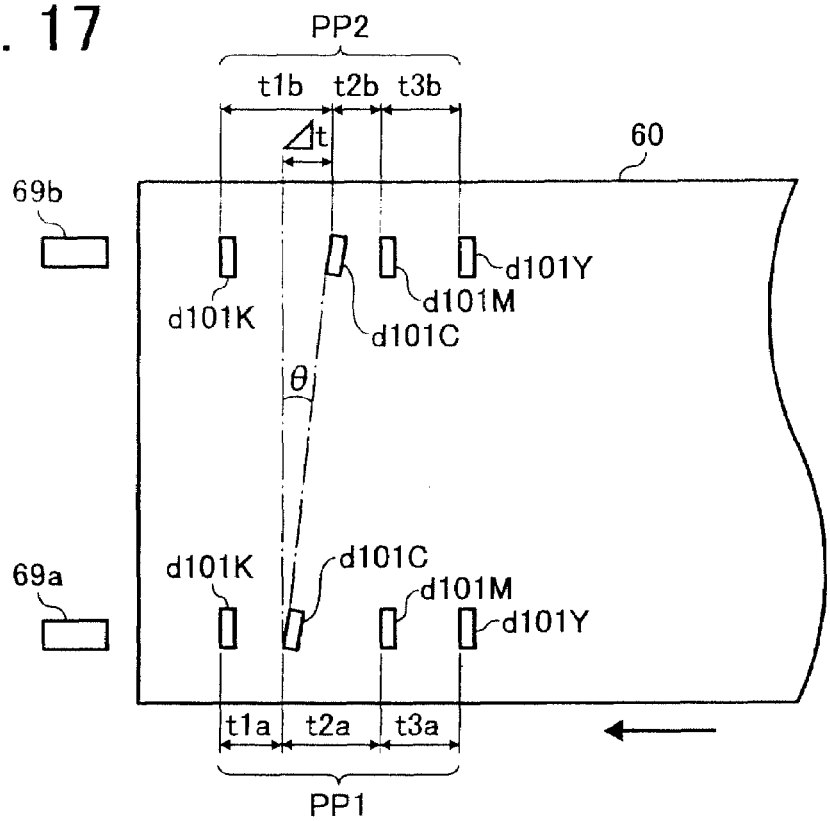
FIG. 17 is a schematic view of reference images formed on an each side of a transfer belt, in which positional deviation is occurring in the reference images with a skew effect.

However, if an error condition such as assembly errors of the photoconductor drum 11 or slanting of the reflection mirrors in the optical writing unit 2 occurs, two corresponding reference images d101C in the reference image patterns PP1 and PP2 may have a positional deviation as shown in FIG. 17 with a skew effect.

If the positional deviation occurs by a skew effect, the photosensor 69*a* may detect the reference image d101C at one timing, and the photosensor 69*b* may detect the reference image d101C at another timing, which may be different from the above-mentioned corresponding timing.

Such a detection timing difference between the two reference images d101C may be expressed as a time lag "Δt" as shown in FIG. 17.

A skew angle θ may be determined based on the time lag "Δt" and a moving speed of transfer belt 60.

Furthermore, if a skew effect occurs in other reference images d101K, d101M, and d101Y, a skew angle θ for other reference images d101K, d101M, and d101Y may be determined similarly to the reference image d101C.

The controller 150 may sequentially store a detection timing of reference images d101K, d101C, d101M, and d101Y to the RAM 150*b*, and may determine detection intervals of t1*a*, t2*a*, t3*a*, t1*b*, t2*b*, t3*b* for the reference image patterns PP1 and PP2.

If a time lag Δt occurs for a reference image diol or S101, the controller 150 may compute a skew angle θ.

Based on a computed skew angle θ, the controller 150 may instruct the mirror slanting unit to slant a reflection mirror for suppressing the skew effect.

Figure 18:
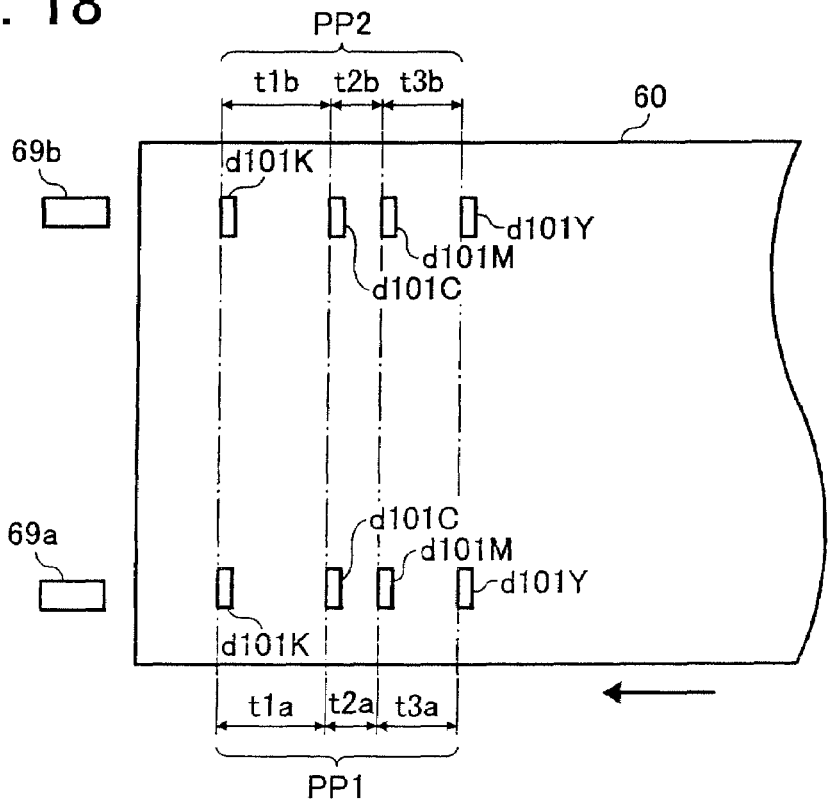
FIG. 18 is a schematic view of reference images formed on an each side of a transfer belt, in which positional deviation is occurring in the reference images in a sub-scanning direction.

Furthermore, for example, if a drive timing of a polygon mirror or light source in the optical writing unit 2 may deviate from a normal timing, a positional deviation may occur in the reference image d101C in a sub-scanning direction as shown in FIG. 18.

If such positional deviation occurs, the detection intervals of t1*a*, t2*a*, and t3*a* may have different values from each other, and the detection intervals of t2*b*, t2*b*, and t3*b* also may have different values from each other as shown in FIG. 18.

If a positional deviation caused by skew effect also occurs, the detection intervals of t1*a*, t2*a*, and t3*a* or detection intervals of t2*b*, t2*b*, and t3*b* may also have different values.

In such a case, the controller 150 may correct an effect caused by the skew effect by using a time lag Δt for the detection intervals of t1*a*, t2*a*, t3*a*, t1*b*, t2*b*, and t3*b*.

After such a correction for eliminating the skew effect, the controller 150 may determine a positional deviation amount of the images in the sub-scanning direction.

Based on a computed positional deviation amount, the controller 150 may correct a drive timing of the polygon mirror or light source in the optical writing unit 2 so that the positional deviation of K, C, M, and Y images in the sub-scanning direction may be suppressed or reduced.

If such a positional deviation caused by the skew effect and positional deviation in the sub-scanning direction may be corrected as described above, a positional deviation in the main scanning direction may be corrected with the reference images S101K, S101C, S101M, and S101Y of the reference image patterns PP1 and PP2.

As mentioned above, if no positional deviation of images in main scanning direction occurs, the detection intervals of t1*a*, t2*a*, t3*a*, t1*b*, t2*b*, and t3*b* may become substantially equal as mentioned above.

Figure 19:
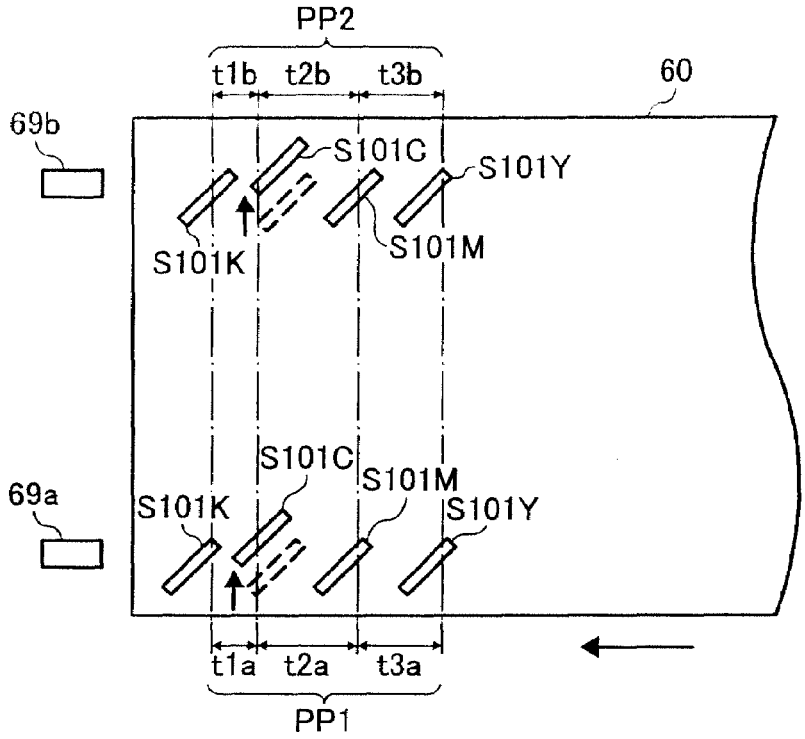
FIG. 19 is a schematic view of reference images formed on an each side of a transfer belt, in which positional deviation is occurring in the reference images in a main scanning direction.

However, if a positional deviation of the images in the main scanning direction occurs for the reference image S101C of the reference image pattern PP2, detection intervals of t1*b*, t2*b*, and t3*b* may have different values as shown in FIG. 19.

If a size of the reference image S101C in the main scanning direction is a normal size (i.e., magnified one time in the main scanning direction), the reference image S101C of the reference image pattern PP1 may similarly deviate from a normal position, and the detection intervals of t1*a*, t2*a*, and t3*a* may have different values from each other. The detection interval of t1*a*, t2*a*, and t3*a* may synchronize with the detection interval of t1*b*, t2*b*, and t3*b*, respectively, as shown in FIG. 19.

Figure 20:
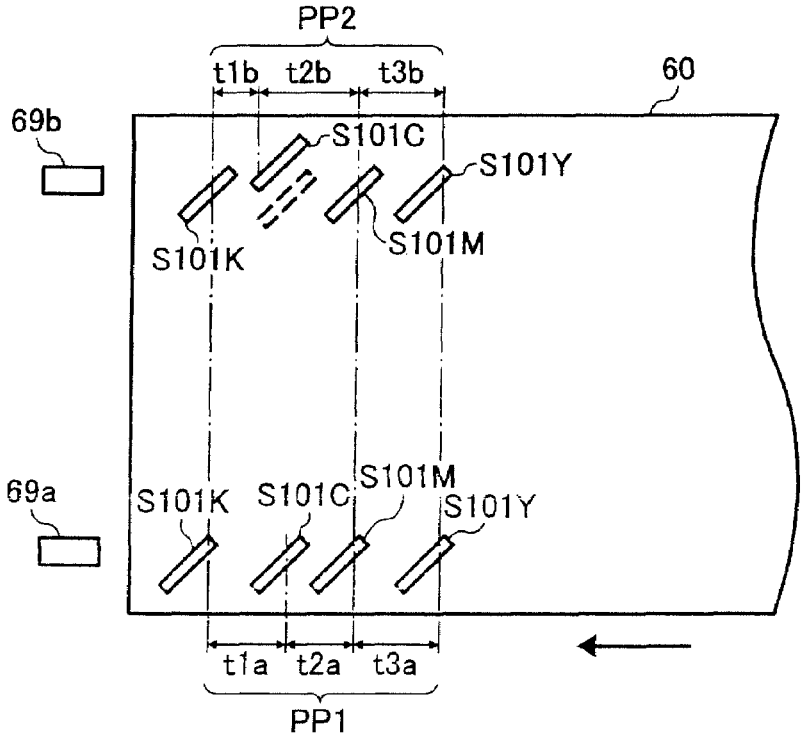
FIG. 20 is a schematic view of reference images formed on an each side of a transfer belt, in which positional deviation is occurring in the reference images with a lesser level.

If a size of the reference image S101C in the main scanning direction becomes greater than a normal size (i.e., magnified more than one time in the main scanning direction), the reference image S101C of the reference image pattern PP2 may deviate from a normal position in the main scanning direction, but the reference image S101C of the reference image pattern PP1 may not deviate from a normal position in main scanning direction or may deviate from a normal position by a lesser level as shown in FIG. 20.

The controller 150 may compute a positional deviation of the images in the main scanning direction for the reference images S101K, S101C, S101M, and S101Y in the reference image patterns PP1 and PP2 based on detection intervals of t1*a*, t2*a*, t3*a*, t1*b*, t2*b*, and t3*b*, and a moving speed of the transfer belt 60.

The controller 150 may also compute a magnification of the reference images S101K, S101C, S101M, and S101Y in the main scanning direction.

Based on computed results, the controller 150 may correct a drive timing of the polygon mirror, or instruct the mirror slanting unit to slant the reflection mirror to suppress a positional deviation of the images.

By suppressing the skew effect and positional deviation of the images in the sub-scanning direction and main scanning direction for each color, the image forming apparatus 100 may produce a full color toner image having a lower image disturbance.

In the image forming apparatus 100, depending on an operated time of the developer unit 20Y, a given amount of fresh image developer may be refilled to the casing 21Y from the developer cartridge 40Y at a given refilling timing, which may be set in advance.

In an exemplary embodiment, for example, "two grams" of image developer may be refilled to the casing 21Y when the developer unit 20Y is operated for "ten minutes." In other words, image developer may be refilled at a rate of 0.2 g/min. Such time and amount conditions may be used as standard conditions.

The image forming apparatus 100 may include a timer (not shown) to check an operated time of the developer unit 20Y.

If the timer recognizes a given operated time of the developer unit 20Y such as five minutes, the controller 150 may compute a refilling amount of fresh image developer, and may instruct a refilling of fresh image developer when a new image forming operation is resumed after such computing.

Figure 21:
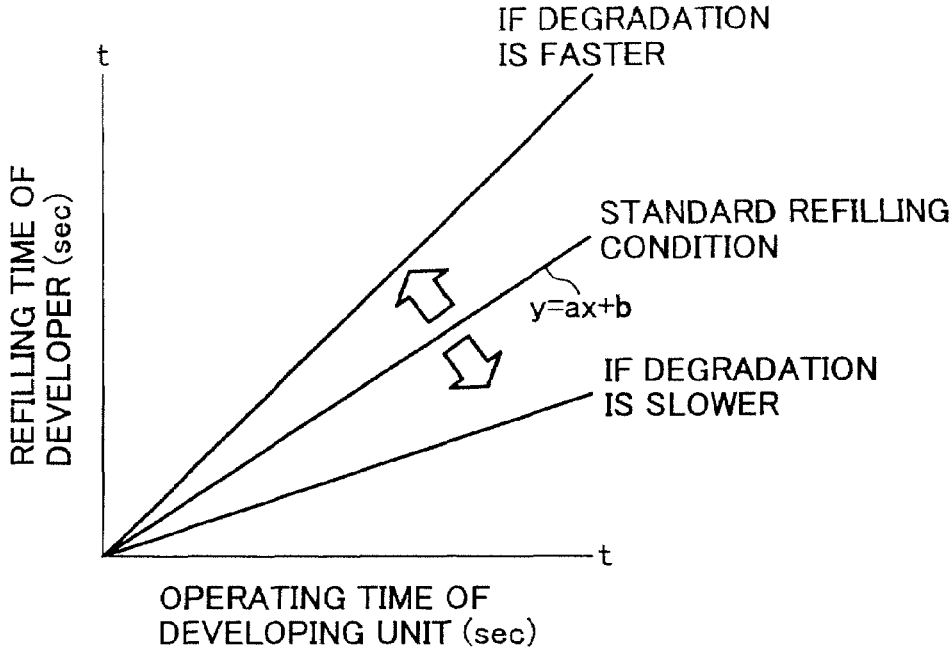
FIG. 21 shows a relationship between a refilling time of fresh developer and an operated time of a developing unit.

FIG. 21 shows a relationship between an operating time of the developer unit 20Y and a refilling time of the fresh image developer, in which a given standard refilling condition of the fresh image developer is shown as a reference condition.

The controller 150 may judge a degradation level of the image developer in the developer unit 20Y by referring to a given standard refilling condition of the image developer.

As shown in FIG. 21, if the controller 150 judges that a degradation level of the image developer is progressing faster with respect to the given standard refilling condition, the controller 150 may increase a refilling amount of fresh image developer to the developer unit 20Y.

Figure 5:
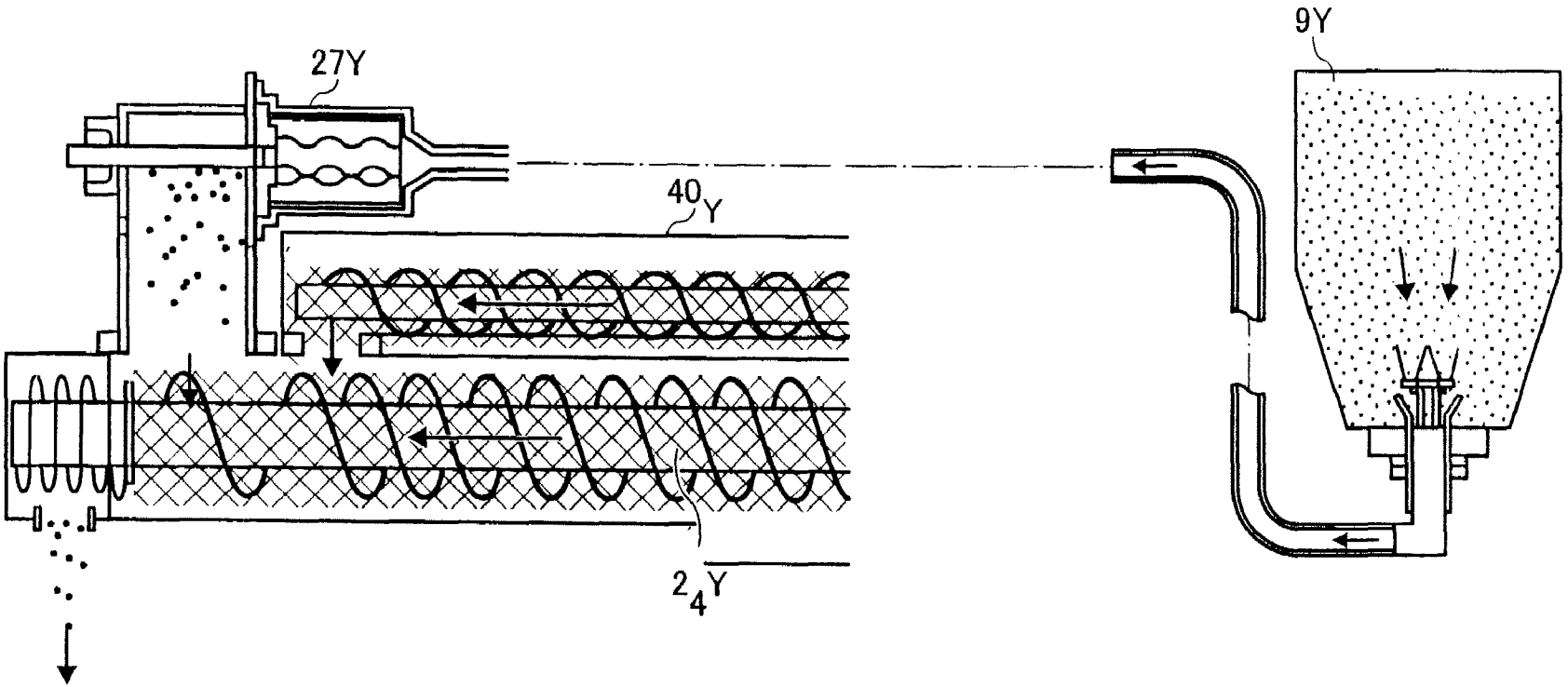
FIG. 5 shows an example flow direction of image developer in an image forming apparatus.

During such control, the degraded image developer may be ejected from the developer unit 20Y as shown in FIG. 5.

With such a process, a degradation of the image developer in the developer unit 20Y may be effectively suppressed or reduced.

On the other hand, if the controller 150 judges that a degradation of the image developer is progressing slower with respect to the given standard refilling condition, the controller 150 may decrease a refilling amount of fresh image developer to the developer unit 20Y.

With such a process, a lifetime of the image developer in the developer unit 20Y may be effectively extended.

Similarly to the developing indicator $\gamma$ (mg/cm$^2$/kV), a voltage Vk used for the image forming process may have a reference voltage set for the image forming process.

If an actual voltage for the image forming process becomes greater or smaller than the reference voltage set for the image forming process, fresh image developer may be supplied (or refilled) to the developing unit 1 to maintain a condition of the image developer in the developing unit 1 at a preferable level.

Figure 22:
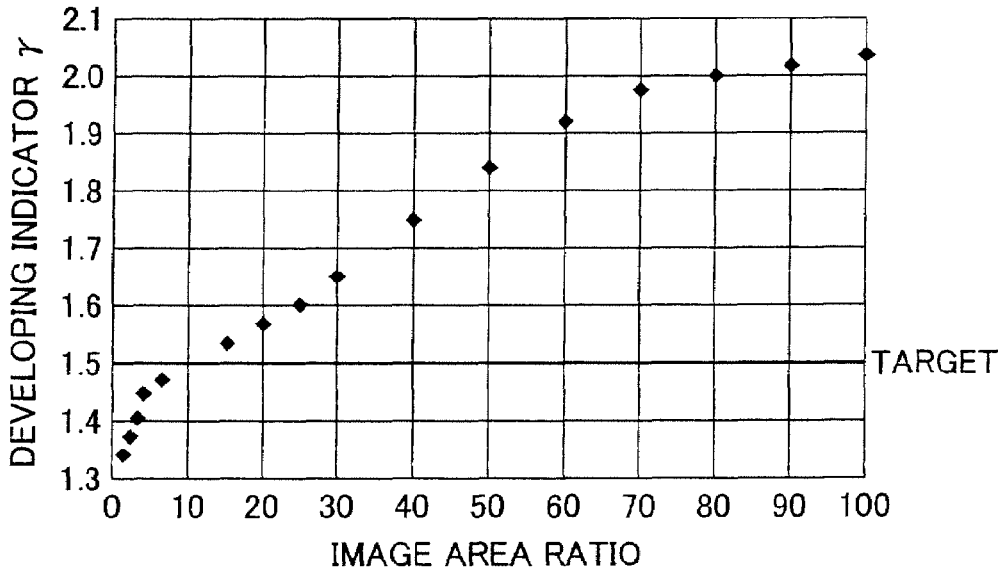
FIG. 22 is a graph showing a relationship between an image area ratio and a developing indicator.

FIG. 22 is a graph showing a relationship between an image area ratio (%) and developing indicator $\gamma$ (mg/cm$^2$/kV), which are shown on a horizontal axis and on a vertical axis, respectively.

The developing indicator $\gamma$ may indicate a relationship between a developing potential and an amount of toner adhered on a unit area of an image carrier such as a transfer belt 60.

The developing potential may mean a potential difference between a latent image formed on a surface of a photoconductor and a surface of a developing sleeve of a developing roller.

In one example experiment, the image forming apparatus 100 conducted a printing operation continuously under a condition that the transfer belt 60 was moved at a standard line speed (e.g., 138 mm/sec) and a toner ratio in image developer was maintained at a given level, in which an image area ratio may be changed.

Specifically, the image forming apparatus 100 conducted a continuous printing operation of 200 sheets while differentiating an image area ratio.

Although the experiment was conducted by maintaining a toner ratio in the image developer at a given level, the developing indicator $\gamma$ may become greater as an image area ratio becomes greater as shown in FIG. 22.

The greater image area ratio may mean that a replacement amount of toner particles in a given period of time becomes a greater level.

Such an increased developing indicator $\gamma$ may be caused by a decrease of charge-ability of carrier particles, wherein such a decrease of charge-ability of carrier particles may be caused by an adhesion of toner particles to the surface of the carrier particles.

Such an unfavorable effect to the carrier particles may become greater as a contact probability of toner particles and carrier particles becomes greater.

FIG. 22 shows an example trend that the developing indicator $\gamma$ becomes greater as the image area ratio exceeds a reference value of image area ratio.

In general, a developing indicator $\gamma$ that is too great may indicate a degradation of carrier particles by a surface contamination by toner particles or the like.

Specifically, in an exemplary embodiment, a reference value of image area ratio may be set to 5% in FIG. 22.

FIG. 22 shows a trend that the developing indicator $\gamma$ becomes greater as the image area ratio exceeds a reference value of 5%.

FIG. 22 also shows a trend that the developing indicator $\gamma$ becomes significantly smaller as the image area ratio becomes smaller. Specifically, FIG. 22 shows a trend that the developing indicator $\gamma$ becomes significantly smaller as the image area ratio becomes 3% or less.

Such a significant decrease of the developing indicator $\gamma$ may occur due to an unfavorably increased charge-ability of carrier particles and toner particles.

A smaller image area ratio may mean that toner particles and carrier particles are less frequently replaced or refilled into a developing unit. In such a case, toner particles and carrier particles may be agitated for a longer period of time by a transport screw, and thereby toner particles and carrier particles may be degraded by submerging of additives into toner particles, and scraping of charge control agents from carrier particles, by which charge-ability of the carrier particles and toner particles may not be effectively controlled but may be unfavorably increased.

Furthermore, carrier particles and toner particles may be charged to an opposite polarity, which is opposite to a normal polarity. Such a condition may lead to a production of an abnormal image.

As such, toner particles may not be replaced (or refilled) so often when an image having lower image area ratio is produced. Accordingly, degraded carrier particles and toner particles may affect the developing indicator $\gamma$, and cause a lower image quality. For example, an unintended spotty image may be produced on a sheet.

In an exemplary embodiment, image developer may be replaced if an image area ratio (%) becomes 3% or less, for example, to suppress or reduce the above-explained drawbacks.

Hereinafter, a method of setting an image forming condition relating to an image developer is explained with a flow chart shown in FIG. 23. A degradation level of image developer may be determined based on such a control flow.

At step S1, a CPU (central processing unit) of the controller 150 may check whether an image developer in the developer unit 20 is a newly installed one.

Specifically, the CPU may check an identification chip (not shown) provided to the developer unit 20 to determine whether the image developer contained in the developer unit 20 is a newly installed one.

If the CPU judges that the image developer is not a newly installed one (NO at step S1), the control process is ended.

If the CPU judges that the image developer is a newly installed one (YES at step S1), the CPU may set an initial condition for the T-sensor at step S2.

Such a new image developer may be installed in the developing unit 1 in several cases. Such cases may include a newly manufactured image forming apparatus, a replacement of a developing unit with a new one, a replacement of an image developer with new one, for example.

At step S2, the CPU may drive the developing unit 1 under an initial condition set for the T-sensor and an initial toner ratio setting.

For example, the developing unit 1 may be operated under a condition of a toner ratio setting in the image developer as 7 wt % (weight percent).

In such a condition, the T-sensor may output a given voltage signal corresponding to a toner ratio setting (e.g., 7 wt %). For example, a reference control voltage "Vt_ref" of the T-sensor 26 may be set to 3V for a normal image forming operation.

Under such a toner and sensor setting, the CPU may control a refilling amount of toner particles so that the T-sensor outputs a voltage signal of 3V constantly.

At step S3, the CPU may instruct a checking operation for the developing indicator γ. Specifically, the CPU may conduct such a checking operation in a similar manner as explained above as a self check operation.

At step S3, a relationship of image concentration and developing potential may be checked with a method explained with reference to FIG. 11. Specifically, such a relationship may be expressed with a function of "y=ax+b" as shown in FIG. 11.

In such a function, coefficient "a" of "y=ax+b" may represent a developing indicator γ.

If "y=0" is assigned to "y=ax+b," an initial voltage Vk may be obtained as shown in FIG. 22.

The initial voltage Vk may be used as a voltage value to start an image forming, and may also be used to judge a degradation level of the image developer.

At step S4, the CPU may store such a developing indicator γ and initial voltage Vk to the RAM 150*b* as reference data. Such reference data may be stored in a table format, for example.

Table 4 shows one example table format, which is used for selecting a developing indicator and starting voltage for image forming, wherein the developing indicator may be determined based on the initial developing indicator γ, and the starting voltage may be determined based on the initial voltage Vk.

TABLE 4

| | Developing indicator | | | | | | |
|---|---|---|---|---|---|---|---|
| | <Initial γ | Initial γ≦ | Initial γ + 0.1≦ | Initial γ + 0.2≦ | Initial γ + 0.3≦ | Initial γ + 0.4≦ | Initial γ + 0.5≦ |
| Correction Index | 0.8 | 0.8 | 0.9 | 1 | 1.1 | 1.2 | 1.3 |

| | Starting Voltage | | | | |
|---|---|---|---|---|---|
| | ≦Initial Vk-100 | ≦Initial Vk-60 | ≦Initial Vk-30 | ≦Initial Vk | <Initial Vk |
| Correction index | 1.3 | 1.2 | 1.1 | 1 | 1 |

After completing step S4, the image forming apparatus 100 may conduct a normal image forming operation.

At first, as a standard condition, one (1) gram of image developer may be refilled when the developing unit 1 is operated for a given accumulated time such as five minutes, wherein such accumulated time may mean a total operated time of developing unit 1 because the developing unit 1 may be operated sporadically in the image forming apparatus 100.

After such refilling, a developing process counter (not shown) may be reset to "zero," and then the developing process counter re-starts a new time-counting.

Hereinafter, it is assumed that the developing unit 1 is operated under a condition having the developing indicator γ of 1.5 and initial voltage Vk of −10V as initial conditions, for example.

When the above-mentioned self check operation is started at a given timing, the controller 150 may compute an average value of an image area ratio of images, which have been formed in the past image forming operation.

Based on the result of the self check operation, the controller 150 may detect a developing indicator and starting voltage used in the past image forming operation.

Based on the detected image area ratio, developing indicator, and starting voltage, the controller 150 may determine a correcting coefficient for image area ratio, developing indicator, and starting voltage by referring to Table 4.

If the average value of the image area ratio is 3%, developing indicator is 1.6, and starting voltage is −13V, the controller 150 may select a correcting coefficient of 0.9 for the average image area ratio of 3%, a correction coefficient of 0.9 for the developing indicator, and a correction coefficient of 1 for the starting voltage.

In the case of a developing indicator, the developing indicator of 1.6 is greater than the initial developing indicator of 1.5 by 0.1 mg/cm$^2$/kV.

In the case of a starting voltage, the starting voltage of −13V is smaller than the initial voltage Vk of −10V by −3V.

Then, a refilling amount of fresh image developer may be computed with the following equation.

A refilling amount of fresh image developer(gram)=1 (gram)×0.9×0.9×1.0=0.81(gram)

(1 gram is a standard refilling amount of fresh image developer in this example case.)

Accordingly, until a next self check operation, a fresh image developer of 0.81 gram may be refilled for a five-minute operation of the developing unit 1.

In the above-explained case, fresh image developer may be refilled into the developing unit 1 with a given time interval (e.g., every five minutes).

Such a refilling time may be set or changed to any time, as required, such that image quality and a refilling amount of image developer may be stabilized.

The above-mentioned average image area ratio (%) may be computed based on data of an image area ratio (%) for each one of the image-produced sheets. The image area ratio (%) for each sheet may be computed by counting a number of light emitting elements used for writing a latent image and converting the number of light emitting elements into an image area ratio (%), for example.

When conducting such a correction, an average image area ratio (%) may be computed using data between a first timing and second timing. In such a case, all image area ratio (%) data for all sheets produced between the first timing and second timing may be used for such a correction.

For example, the first timing may be a timing when a voltage control is conducted, and the second timing may be a timing when a self check operation is conducted.

However, an average image area ratio (%) may be preferably computed by a moving average method, in which history data that may be suitable for determining a present condition of image developer may be used.

Although such a moving average method may be conducted by simply averaging data of several sheets recently produced, in an exemplary embodiment, the following formula (I) maybe used for computing an average image area ratio (%) for simplifying a computing process.

A computing method using the following formula (I) may be preferably used because a NVRAM (non-volatile random access memory) may not need to store a large amount of data for image area ratios, by which a memory area of NVRAM may be effectively and efficiently used for the computing process.

$$M(i)=(1/N)(M(i-1)\times(N-1)+X(i)) \quad (1)$$

M(i) represents a present average value of an image area ratio computed by a moving average method.

M(i−1) represents a last average value of an image area ratio computed by a moving average method.

N represents an accumulated number of sheets produced by past image forming operations.

X(i) represents a present value of an image area ratio.

M(i) and X(i) may be computed for each color separately.

As such, in an exemplary embodiment, a present value of the image area ratio may be computed based on a lastly computed value of the image area ratio, computed by the moving average method. Accordingly, a memory device such as NVRAM may not need to store all the data of the image area ratio generated in past image forming operations, by which such a memory device may not need a larger amount of working area.

Furthermore, a number of sheets used for computing the image area ratio may be changed (or adjusted) so that an image developer condition may be controlled more precisely.

For example, an image developer condition may be controlled to a preferable level by changing a number of sheets used for computing the image area ratio depending on environmental conditions, which may change over the time.

Hereinafter, another control method according to an exemplary embodiment is explained.

Such a control method may have a different process when the image forming apparatus 100 produces images having a lower image area ratio continuously.

When a self check operation is conducted, the image forming apparatus 100 may conduct a compulsory consumption of toner particles if an average image area ratio for a past image forming operation is determined to be lower than a given value.

For example, if such an average image area ratio is 3% or less, the image forming apparatus 100 may conduct a compulsory consumption of toner by producing a solid image on a plurality of A4-sized sheets as shown in Table 5. For example, solid images may be produced on five A4-sized sheets.

When toner particles are consumed by such compulsory consumption, toner particles may be refilled automatically into the developer unit 20, by which a toner ratio in the developer unit 20 may be maintained at a given level.

If the image forming apparatus 100 produces images having lower image area ratios, carrier particles may degrade and additives may submerge into toner particles, by which image quality may degrade over the time.

In view of such a drawback, if a history average value of the image area ratio becomes lower than a given value (e.g., 3%), a toner replacement (or refilling) may be conducted compulsorily by forming consumption-purpose toner images on a sheet.

With such compulsorily toner replacement (or refilling), a degradation of toner particles may be suppressed or reduced, and a fluidity degradation of image developer may also be suppressed or reduced, by which a degradation of carrier particles may also be suppressed or reduced.

TABLE 5

| | Image Area ratio (%) | | | | | | |
|---|---|---|---|---|---|---|---|
| | <3 | 3≦ | 5≦ | 20≦ | 40≦ | 60≦ | 80 |
| correcting coefficient | Compulsory consumption | Compulsory consumption | 1 | 1 | 1.1 | 1.2 | 1.3 |

TABLE 5-continued

| | A3 size | | A4 size | | | | |
|---|---|---|---|---|---|---|---|
| | Developing indicator | | | | | | |
| | <Initial γ | Initial γ≦ | Initial γ + 0.1≦ | Initial γ + 0.2≦ | Initial γ + 0.3≦ | Initial γ + 0.4≦ | Initial γ + 0.5≦ |
| correcting coefficient | 0.8 | 0.8 | 0.9 | 1 | 1.1 | 1.2 | 1.3 |
| | Starting Voltage | | | | | | |
| | | ≦Initial Vk-100 | ≦Initial Vk-60 | ≦Initial Vk-30 | ≦Initial Vk | <Initial Vk | |
| correcting coefficient | | 1.3 | 1.2 | 1.1 | 1 | 1 | |

Hereinafter, another method of setting an image forming condition relating to an image developer is explained with a flow chart shown in FIG. 24. A degradation level of an image developer may be determined based on such a control flow.

Figure 23:
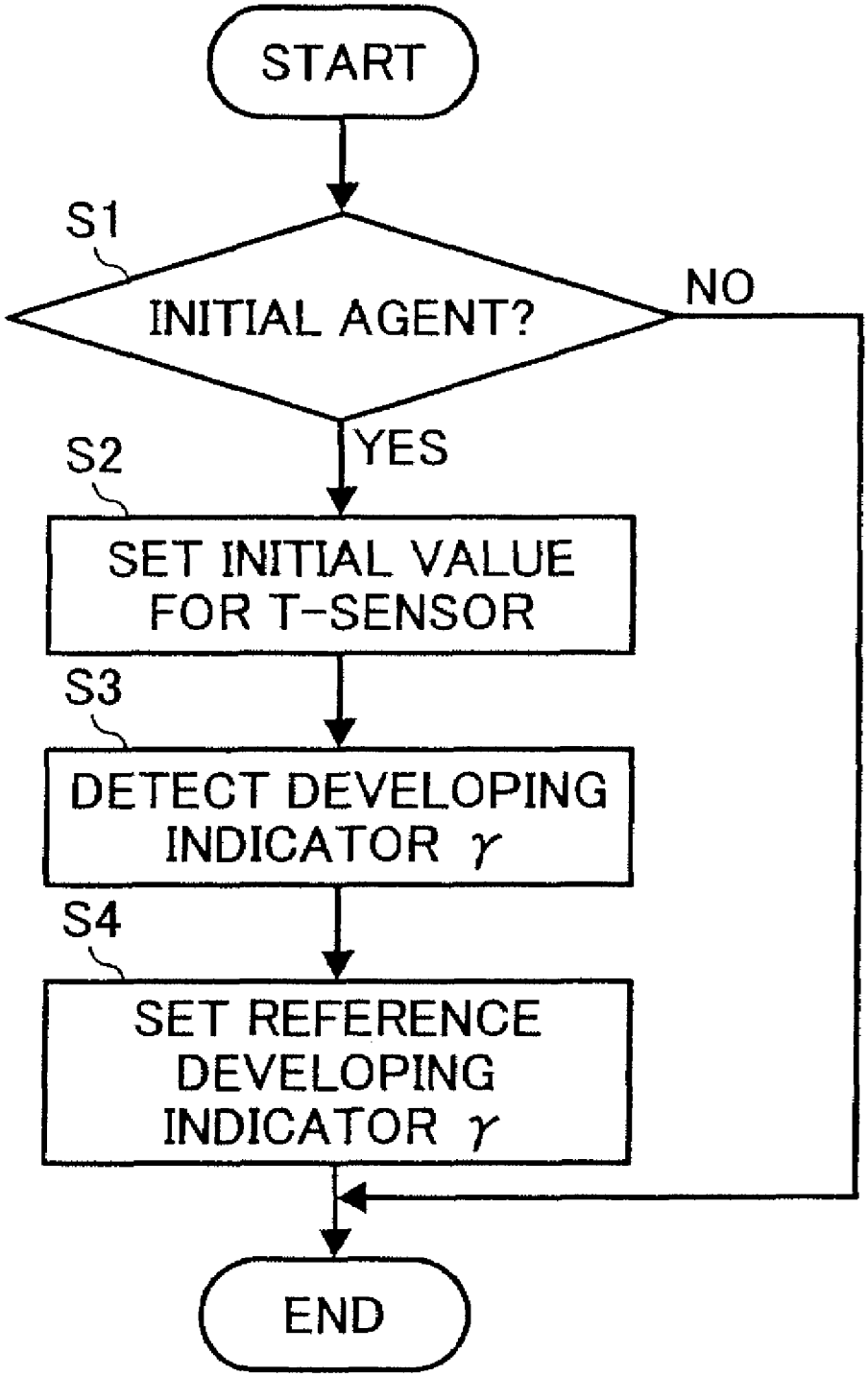
FIG. 23 is a flow chart for setting a developing indicator, used for computing a degradation of image developer.
Figure 24:
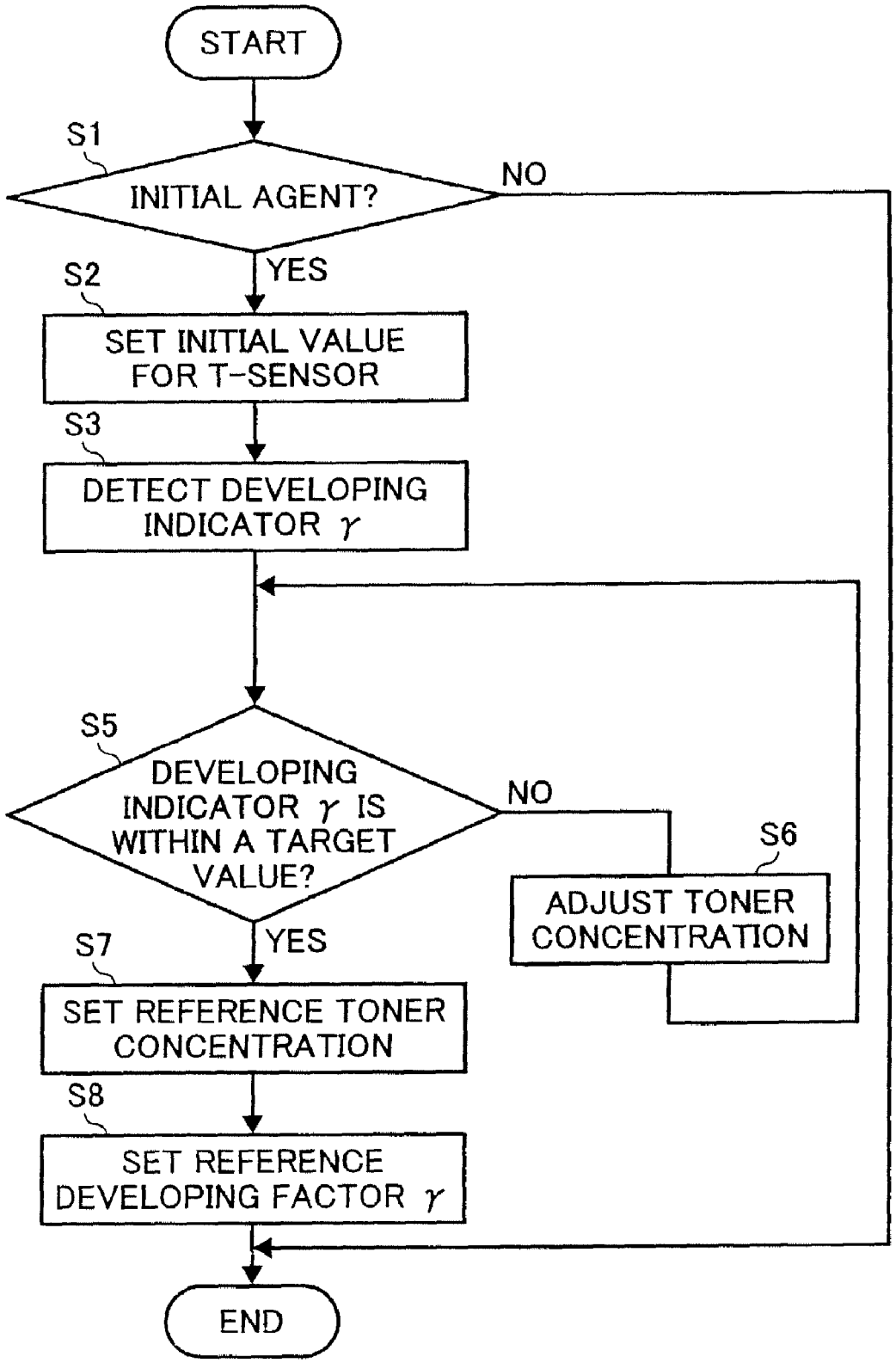
FIG. 24 is another flow chart for setting a developing indicator, used for computing a degradation of image developer.

The flow chart shown in FIG. 24 has steps S1, S2, and S3, which are similar to steps S1, S2, and S3 of the flow chart shown in FIG. 23.

At step S5 in FIG. 24, the CPU may check whether the developing indicator γ is within a given range from a target value.

For example, the CPU may check whether the developing indicator γ is within ±0.05 range of developing indicator of 1.5.

If the CPU judges that the developing indicator γ is not within the target value (NO at step S5), the CPU may instruct a toner ratio adjusting operation at step S6.

For example, if the CPU may judge that the developing indicator γ is lower than a target value, the CPU may instruct a toner refilling operation to adjust a developing indicator γ to the target value.

Furthermore, if the CPU may judge that the developing indicator γ is greater than the target value, the CPU may instruct a consumption of toner particles to adjust a developing indicator γ to the target value.

Furthermore, because an adjustment of an initial voltage Vk to a given value may be difficult, a voltage value obtained at step S5 may be stored as the initial voltage value Vk to the RAM 150*b*, for example.

If the CPU judges that the developing indicator γ is within the target value (YES at step S5), the CPU may set a reference toner ratio at step S7. At step S7, the CPU may set a reference toner ratio based on such an adjusted developing indicator γ, and may assign an output voltage Vt of the T-sensor 26, corresponding to such a reference toner ratio, as a target control voltage (or reference control voltage) "Vt-ref" of the T-sensor 26. Next, at step S8, the CPU may set a reference developing indicator γ.

If a target value of the developing indicator γ is set to 1.5, Table 6 may be prepared for controlling an image developer condition, for example. The CPU may control an image forming process based on Table 6 using the initial voltage value Vk obtained at step S5.

Table 6 may be prepared by assigning "1.5" to an initial developing indicator γ in Table 4.

TABLE 6

| | Developing indicator | | | | | | |
|---|---|---|---|---|---|---|---|
| | <1.5 | 1.5≦ | 1.6≦ | 1.7≦ | 1.8≦ | 1.9≦ | 2.0≦ |
| Correcting coefficient | 0.8 | 0.8 | 0.9 | 1 | 1.1 | 1.2 | 1.3 |

As such, an amount of image developer in the developer unit 20 may be corrected or determined based on an initial condition of the image developer, which is initially provided or installed in the developer unit 20.

The initial condition of the image developer may be detected by the above-mentioned image detector including the photosensor 69 and reflection member 70, which may detect an image pattern formed on the transfer belt 60. In other words, the image detector may be termed "toner adhesion detector."

Although each of the developing units 20Y, 20M, 20C, and 20K may have a similar configuration to one another, and are configured with similar parts, a dimensional deviation may be observed among the developing units 20Y, 20M, 20C, and 20K because of a dimensional deviation of similar parts even though such dimensional deviation may be small.

For example, a gap between a photoconductor member and developing roller, or a gap between a doctor blade and developing sleeve may be deviated among the developing units 20Y, 20M, 20C, and 20K.

Such dimensional deviation may cause a variation of developing indicator γ among the developing units 20Y, 20M, 20C, and 20K even if a given developing indicator γ is set as a target value for the image developer.

Such variation of the developing indicator γ may be reduced by reducing dimensional deviation in the developing units 20Y, 20M, 20C, and 20K. Such dimensional deviation may be corrected by modifying a mechanical configuration of the developer unit 20.

However, a modification of a mechanical configuration of the developer unit 20 may increase a manufacturing cost, which may not be preferable.

In exemplary embodiments, a variation of the developing indicator γ may be reduced by using the above-described controlling method, which may not need the above-mentioned modification of the mechanical configuration, by which a manufacturing cost of the developer unit 20 may be reduced or suppressed.

As such, in exemplary embodiments, a variation of a toner adhesion amount caused by dimensional deviation may be adjusted with a method of controlling the toner ratio in an image developer.

Accordingly, a target value of a toner adhesion amount may be obtained and maintained by controlling a refilling amount of the image developer or carrier particles.

Furthermore, the above-described controlling method may decrease variation of developability of developing unit 1, by which image forming conditions used for voltage controlling may be controlled by values which may be set in a center of value range shown in the Tables (e.g., Table 6).

Therefore, even if developability of the developing unit 1 varies due to an image forming operation conducted for a longer period time, a voltage control may be conducted with a relatively greater range of image forming conditions, by which an image concentration may be maintained at a given level.

Accordingly, the image forming apparatus 100 having a longer lifetime may be realized.

Hereinafter, another example method for controlling image developer in the image forming apparatus 100 is explained.

In such an example method, the cartridge 40 may contain only carrier particles as fresh image developer. Such carrier particles may be refilled into the developer unit 20 in a similar manner as previously explained with the above-described exemplary embodiments.

However, if only carrier particles are refilled into the developer unit 20, a toner ratio (or toner concentration) in the developer unit 20 may be decreased in some part of the developer unit 20.

Therefore, in such an embodiment, when refilling carrier particles, toner particles may also be refilled from the toner cartridge 9 to the developer unit 20 so that a toner ratio in an image developer may be maintained at a target value.

A refilling amount of the toner particles may be determined based on the following formula and a target value of the toner ratio.

Refilling amount of toner=(target value of toner ratio/100)×(refilling amount of fresh carrier particles)

For example, if a refilling amount of carrier particles is five (5) grams, and a target value of toner ratio is seven (7) wt %, then a refilling amount of toner particles may become 0.35 grams (i.e., 7/100×5=0.35).

If the image developer in the developer unit 20 is used for a longer period of time without refilling fresh image developer, a charge-ability of the image developer may degrade or degradation of the carrier particles may occur due to an adhesion of the toner particles onto the carrier particles.

In an exemplary embodiment, because fresh carrier particles and toner particles may be supplied to the developer unit 20 as fresh image developer, image developer in the developer unit 20 may be maintained at a preferable condition.

If carrier particles are commonly used for each color, carrier particles may be supplied to the developer units 20Y, 20M, 20C, and 20K from a same cartridge, by which a configuration for refilling carrier particles may be simplified.

Furthermore, by refilling toner particles when refilling carrier particles, the toner ratio in the developer unit 20 may not be decreased, by which the image forming apparatus 100 may reduce or suppress image concentration variation due to refilling of the carrier particles.

In the above-explained exemplary embodiments, a degradation level of image developer may be checked using an average value of image area ratio between two self check operations.

However, other methods may also be used. For example, instead of an average value of toner consumption or an average value of history data of developer refilling, history data storing a number of refilling times may be used to effectively check a degradation level of image developer in a similar manner.

Furthermore, in the above-explained exemplary embodiments, history data for an image forming process may be acquired between two self check operations. However, history data for the image forming process may be acquired with any interval such as every 20 sheets.

In other words, such an interval may be changed depending on a condition of an image forming apparatus.

A degradation level of image developer may be computed by using only history data of the image area ratio.

However, a degradation level of image developer may be more effectively detected by using history data of the image area ratio with at least anyone of a developing indicator γ and an operated time information of the developing unit.

Hereinafter, carrier particles and toner particles, used as image developer, in exemplary embodiments are explained.

A carrier particle may have a core, made of ferrite material such as copper/zinc ferrite, manganese ferrite, and/or manganese/magnesium ferrite, for example.

Such a core may be added with a resistance adjusting agent such as bismuth (Bi) and zircon (Zr).

Furthermore, by adjusting conditions (e.g., temperature, time, atmosphere) in a baking process or other process, as required, a core having a higher magnetization intensity and higher resistance may be prepared.

Furthermore, such a core made of ferromagnetic material may be coated with resinous material such as acrylic resin, polyester resin, silicone resin, and fluorocarbon resin, for example.

Such resinous material may be selected considering electric resistivity of the carrier particle, and/or charge-ability for the toner particle, as required.

Furthermore, a charge controlling agent (e.g., carbon black, aluminum oxide, titanium oxide) may be added to resinous material to adjust characteristics of the carrier particle. Furthermore, magnetic particles may be dispersed in such resinous material.

Such a carrier particle may preferably have a smaller weight average particle diameter of 25 μm to 45 μm, for example.

If the weight average particle diameter of the carrier particle is set to 45 μm or less, a magnetic brush may be formed more densely, by which image gradation and solid image uniformity may be enhanced.

If the weight average particle diameter of the carrier particle may becomes too small, carrier particles may unfavorably adhere each other.

Furthermore, such a carrier particle may preferably have a magnetization intensity of 60 emu/g to 80 emu/g at 1 kOe, for example.

In general, the smaller the particle diameter of the carrier particle, the smaller the magnetization intensity of the carrier particle and the more adhesion of carrier particles.

Accordingly, such a carrier particle may preferably have a magnetization intensity of 60 emu/g or more, for example.

Furthermore, if the magnetization intensity of the carrier particle becomes too great, an image quality to be formed may unpreferably degrade even if the surface of the carrier particle is coated with resinous material.

Such magnetization intensity of the core may be adjusted by selecting types and amounts of additives, for example.

A toner particle may include a thermoplastic resin and a pigment (e.g., carbon black, copper phthalocyanine, quinacridone pigment, bisazo pigment), for example. Such resin may preferably include styrene-acrylic, and/or polyester resin, for example.

Such a toner particle may further include a wax, used for enhancing a fixing property of the toner, such as polypropylene wax, and an alloy-including colorant for controlling the charge-ability of the toner particle.

Furthermore, such a toner particle may include oxide, nitride, or carbide on its surface portion, wherein such oxide, nitride, or carbide may include a surface-treated silica, alumina, and titanium oxide, or the like.

Furthermore, such a toner particle may include fatty acid metal salt, fine particle resin or the like on its surface portion.

Such a toner particle may preferably have a smaller particle diameter for realizing an image having higher image quality and higher precision.

Accordingly, such a toner particle may preferably have a volume average particle diameter of 3 μm to 8 μm, for example.

If the volume average particle diameter of the toner particle becomes too small, toner particles may adhere on a surface of carrier particles when two component image developer is agitated in a developing unit for a longer period of time, by which charge-ability of the carrier particles may unpreferably degrade.

If the volume average particle diameter of a toner particle becomes too large, an image having a higher image quality and higher precision may not be produced in a stable manner.

In an exemplary embodiment, a toner ratio in image developer may be preferably set from 3 wt % to 15 wt %, for example.

If the toner ratio becomes too small, an unfavorable conduction may occur from a developing sleeve of a developing roller to a surface of a photoconductor member via a magnetic brush, by which an abnormal image such as an unintended spotty image may occur.

If the toner ratio becomes too great, an abnormal image such as fogging may occur, by which an image having a higher image quality may not be produced.

Accordingly, in an exemplary embodiment, a toner ratio in an image developer may be preferably set from 3 wt % to 15 wt % to obtain an effective image concentration on a printed sheet.

In the above explained exemplary embodiments, carrier particles may be supplied to a developing unit such that degradation of the carrier particles may be suppressed or reduced, by which a lifetime of the developing unit may be extended while maintaining image quality without frequent maintenance work to be conducted by a service person.

Furthermore, by replacing (or refilling) image developer or carrier particles in a developing unit, degradation of the image developer or the carrier particles in the developing unit may be suppressed even if images having a higher image area ratio are produced for a large number of times.

If such replacement (or refilling) of image developer or carrier particles is not conducted effectively when images having a higher image area ratio are formed for a large number of times, the carrier particles may have a film layer of toner particles thereon, by which the toner particles may not be effectively charged.

Furthermore, by replacing (or refilling) image developer or carrier particles in a developing unit, degradation of the image developer or the carrier particles in the developing unit may be suppressed even if images having a significantly lower image area ratio are produced.

If such replacement (or refilling) of image developer or carrier particles is not conducted effectively when images having a significantly lower image area ratio are produced, a coating layer of the carrier particles may be damaged or the carrier particles may adhere to each other, by which the carrier particles may not conduct a normal charging to the toner particles, and cause degradation of image forming.

In the above-described embodiment, two-component type image developer having toner particles and carrier particles may be used as image developer. However, one-component type image developer having toner particles may be similarly used for image forming operations without departing from the above-described method.

With the above-described image forming apparatus according to exemplary embodiments, image quality degradation, toner particles sputtering, and/or carrier particles adhesion may be effectively reduced or suppressed. Furthermore, a lifetime of the developing unit or other units may be maintained at a given level without frequent visiting maintenance work by a service person, by which an image forming apparatus may preferably have a lower running cost.

Numerous additional modifications and variations are possible in light of the above teachings. It is therefore to be understood that within the scope of the appended claims, the disclosure of the present invention may be practiced otherwise than as specifically described herein.

This application claims priority from Japanese patent application No. 2006-116480 filed on Apr. 20, 2006 in the Japan Patent Office, the entire contents of which is hereby incorporated by reference herein.

What is claimed is:

1. An image forming apparatus, comprising:

an image carrier configured to form a latent image thereon with a light beam;

a developing unit configured to develop the latent image formed on the image carrier with a two-component image developer including toner particles and carrier particles;

a concentration sensor configured to detect a toner ratio in the developing unit;

a toner supplying unit configured to supply fresh toner particles to the developing unit;

a developer supplying unit configured to supply fresh image developer to the developing unit;

an ejector configured to eject the image developer to an outside of the developing unit;

a condition detector configures to detect a condition of the image developer being used for an image forming operation, and to determine a supply amount of the image developer to supply to the developing unit, the condition including a degradation level of the image developer in the developing unit; and a controller configured to compute a historically-averaged amount of toner particles consumed and supplied in the developing unit, based on a detection result of the condition detector, and to adjust an amount of any one of the image developer and the toner particles to be supplied to the developing unit based on an operated time of the developing unit obtained from a timer and a current condition of the image developer, determined based on the computed historically-averaged amount of toner particles.

2. An image forming apparatus, comprising:

an image carrier configured to form a latent image thereon with a light beam;

a developing unit configured to develop the latent image on the image carrier with a two-component image developer including toner particles and carrier particles;

a concentration sensor configured to detect a toner ratio in the developing unit;

a toner supplying unit configured to supply fresh toner particles to the developing unit;

a carrier supplying unit configured to supply fresh carrier particles to the developing unit;

an ejector configured to eject the image developer to an outside of the developing unit;

a condition detector configured to detect a condition of the image developer being used for an image forming operation, and to determine a supply amount of the toner particles and a supply amount of the carrier particles to supply to the developing unit, the condition including a degradation level of the image developer in the developing unit; and a controller configured to compute a historically-averaged amount of toner particles consumed and supplied in the developing unit, based on a detection result of the condition detector, and to adjust an amount of any one of the toner particles and the carrier particles to be supplied to the developing unit based on an operated time of the developing unit obtained from a timer and a current condition of the image developer, determined based on the computed historically-averaged amount of toner particles.

3. The image forming apparatus according to claim 1, further comprising:

an image area detector configured to detect an image area to be produced on a sheet during an image forming operation, wherein the controller is configured to compute a historically-averaged image area ratio based on a detection result of the image area detector, the historically-averaged image area ratio corresponds to the historically-averaged amount of toner particles consumed and supplied in the developing unit, and the controller is configured to instruct an increase of an amount of any one of the image developer and the toner particles to be supplied to the developing unit when the historically-averaged image area ratio becomes greater than a reference value set for the image area ratio.

4. The image forming apparatus according to claim 1, further comprising:

an image area detector configured to detect an image area to be produced on a sheet during an image forming operation, wherein the controller is configured to compute a historically-averaged image area ratio based on a detection result of the image area detector, the historically-averaged image area ratio corresponds to the historically-averaged amount of toner particles consumed and supplied in the developing unit, and the controller is configured to instruct an increase of an amount of any one of the image developer and the toner particles to be supplied to the developing unit when the controller determines the historically-averaged image area ratio is 3% or less.

5. The image forming apparatus according to claim 1 further comprising:

an image area detector configured to detect an image area to be produced on a sheet during an image forming operation, wherein the controller is configured to compute a historically-averaged image area ratio based on a detection result of the image area detector, the historically-averaged image area ratio corresponds to the historically-averaged amount of toner particles consumed and supplied in the developing unit, and the controller is configured to instruct a compulsory image forming operation for consuming toner particles and a subsequent compulsory replacement of toner particles when the controller determines that the historically-averaged image area ratio is 3% or less.

6. The image forming apparatus according to claim 1, wherein the condition detector includes a toner adhesion detector configured to detect an amount of toner particles used for developing a latent image formed on the image carrier, and the controller is configured to adjust an amount of any one of the image developer and the toner particles to be supplied to the developing unit based on an operated time of the developing unit and a detection result by the toner adhesion detector.

7. The image forming apparatus according to claim 6, wherein the controller is configured to determine a condition of the image developer based on a developing indicator that indicates a relationship between a toner adhesion amount and an image forming voltage, the controller is configured to determine a degradation level of the image developer based on a reference value set for the developing indicator under a given toner ratio condition, the controller is configured to instruct an increase of an amount of any one of the image developer and the toner particles to be supplied to the developing unit when the controller determines that a current developing indicator is greater than the reference value for the developing indicator, and the controller is configured to instruct an increase of an amount of any one of the image developer and the toner particles to be supplied to the developing unit when the controller determines that the current developing indicator is smaller than the reference value for the developing indicator.

8. The image forming apparatus according to claim 6, wherein the controller is configured to determine a condition of the image developer based on an image forming starting voltage determined from a corresponding developing indicator, the controller is configured to determine a degradation level of the image developer using a reference value set for the image forming starting voltage, which is set under a given toner ratio condition, the controller is configured to instruct an increase of an amount of any one of the image developer and the toner particles to be supplied to the developing unit when the controller determines that the current image forming starting voltage is greater than the reference value for the image forming starting voltage, and the controller is configured to instruct an increase of an amount of any one of the image developer and the toner particles to be supplied to the developing unit when the controller determines that a current image forming starting voltage is smaller than the reference value for the image forming starting voltage.

9. The image forming apparatus according to claim 6, wherein the controller is configured to determine an amount of any one of the image developer and the toner particles to be supplied to the developing unit by comparing a current condition of the image developer, being used for image forming operation and detected by the toner adhesion detector, with an initial condition of the image developer, detected by the toner adhesion detector when the image developer is newly installed in the developing unit.

10. The image forming apparatus according to claim 6, wherein the controller is configured to adjust a toner ratio in the image developer based on an initial condition of the image developer, detected by the toner adhesion detector, to maintain the toner ratio in the image developer at the initial condition of the image developer.

11. The image forming apparatus according to claim 1, further comprising:

a vessel configured to store at least any one of the image developer and the carrier particles, wherein the vessel is integrated with the developing unit as cartridge.

12. The image forming apparatus according to claim 1, wherein the condition detector is configured to determine the degradation level of the image developer by comparing a current condition of the image developer being used for image forming operation with an initial condition of the image developer, detected when the image developer is newly installed in the developing unit.

13. An image forming apparatus, comprising:

an image carrier configured to form a latent image thereon with a light beam;

a developing unit configured to develop the latent image formed on the image carrier with an image developer including toner particles and carrier particles;

a concentration sensor configured to detect a toner ratio in the developing unit;

a developer supplying unit configured to supply fresh image developer to the developing unit;

an ejector configured to eject the image developer to an outside of the developing unit;

a condition detector configured to detect a condition of the image developer being used for an image forming operation, and to determine a supply amount of the image developer from the developer supplying unit to supply to the developing unit, the condition including a degradation level of the image developer in the developing unit; and a controller configured to compute a historically-averaged amount of toner particles consumed and supplied in the developing unit, based on a detection result of the condition detector, and to adjust an amount of the image developer to be supplied to the developing unit based on an operated time of the developing unit obtained from a timer and a current condition of the image developer, determined based on the computed historically-averaged amount of toner particles.

14. The image forming apparatus according to claim 2, further comprising:

an image area detector configured to detect an image area to be produced on a sheet during an image forming operation, wherein the controller is configured to compute a historically-averaged image area ratio based on a detection result of the image area detector, the historically-averaged image area ratio corresponds to the historically-averaged amount of toner particles consumed and supplied in the developing unit, and the controller is configured to instruct an increase of an amount of any one of the carrier particles and the toner particles to be supplied to the developing unit when the historically-averaged image area ratio becomes greater than a reference value set for the image area ratio.

15. The image forming apparatus according to claim 2, further comprising:

an image area detector configured to detect an image area to be produced on a sheet during an image forming operation, wherein the controller is configured to compute a historically-averaged image area ratio based on a detection result of the image area detector, the historically-averaged image area ratio corresponds to the historically-averaged amount of toner particles consumed and supplied in the developing unit, and the controller is configured to instruct an increase of an amount of any one of the carrier particles and the toner particles to be supplied to the developing unit when the controller determines the historically-averaged image area ratio is 3% or less.

16. The image forming apparatus according to claim 2, further comprising:

an image area detector configured to detect an image area to be produced on a sheet during an image forming operation, wherein the controller is configured to compute a historically-averaged image area ratio based on a detection result of the image area detector, the historically-averaged image area ratio corresponds to the historically-averaged amount of toner particles consumed and supplied in the developing unit, and the controller is configured to instruct a compulsory image forming operation for consuming toner particles and a subsequent compulsory replacement of toner particles when the controller determines that the historically-averaged image area ratio is 3% or less.

17. The image forming apparatus according to claim 13, further comprising:

an image area detector configured to detect an image area to be produced on a sheet during an image forming operation, wherein the controller is configured to compute a historically-averaged image area ratio based on a detection result of the image area detector, the historically-averaged image area ratio corresponds to the historically-averaged amount of toner particles consumed and supplied in the developing unit, and the controller is configured to instruct an increase of an amount of the image developer to be supplied to the developing unit when the historically-averaged image area ratio becomes greater than a reference value set for the image area ratio.

18. The image forming apparatus according to claim 13, further comprising:

an image area detector configured to detect an image area to be produced on a sheet during an image forming operation, wherein the controller is configured to compute a historically-averaged image area ratio based on a detection result of the image area detector, the historically-averaged image area ratio corresponds to the historically-averaged amount of toner particles consumed and supplied in the developing unit, and the controller is configured to instruct an increase of an amount of the image developer to be supplied to the developing unit when the controller determines the historically-averaged image area ratio is 3% or less.

19. The image forming apparatus according to claim 13, further comprising:

an image area detector configured to detect an image area to be produced on a sheet during an image forming operation, wherein the controller is configured to compute a historically-averaged image area ratio based on a detection result of the image area detector, the historically-averaged image area ratio corresponds to the historically-averaged amount of toner particles consumed and supplied in the developing unit, and the controller is configured to instruct a compulsory image forming operation for consuming toner particles and a subsequent compulsory replacement of toner particles when the controller determines that the historically-averaged image area ratio is 3% or less.

* * * * *